US008911010B2

(12) United States Patent
Conner

(10) Patent No.: US 8,911,010 B2
(45) Date of Patent: Dec. 16, 2014

(54) PIVOTING SWING SEAT WITH CONTROL SYSTEM

(75) Inventor: John P. Conner, Grandville, MI (US)

(73) Assignee: Irwin Seating Company, Grand Rapids, MI (US)

( * ) Notice: Subject to any disclaimer, the term of this patent is extended or adjusted under 35 U.S.C. 154(b) by 40 days.

(21) Appl. No.: 13/527,643

(22) Filed: Jun. 20, 2012

(65) Prior Publication Data

US 2012/0319437 A1 Dec. 20, 2012

Related U.S. Application Data

(60) Provisional application No. 61/498,774, filed on Jun. 20, 2011.

(51) Int. Cl.
*A47B 39/00* (2006.01)
*A47B 83/02* (2006.01)
*A47C 3/12* (2006.01)

(52) U.S. Cl.
CPC ..... *A47C 3/12* (2013.01)
USPC ..... 297/142; 297/140; 297/141; 297/344.25

(58) Field of Classification Search
CPC ..... A47B 3/14; A47B 39/00; A47B 83/02; A47C 3/18; A47C 3/185; A47C 7/68; A47C 9/022
USPC ..... 297/140, 141, 142, 147, 173, 344.24
See application file for complete search history.

(56) References Cited

U.S. PATENT DOCUMENTS

| | | | | | |
|---|---|---|---|---|---|
| 1,961,459 | A * | 6/1934 | Sheldon | 297/142 |
| 2,024,045 | A * | 12/1935 | Johnson | 297/142 |
| 3,186,761 | A * | 6/1965 | Propst | 297/344.24 |
| 3,486,790 | A * | 12/1969 | Barecki et al. | 297/142 |
| 3,535,000 | A * | 10/1970 | Protzmann | 297/142 |
| 3,542,424 | A * | 11/1970 | Khan et al. | 297/344.24 |
| 3,709,555 | A * | 1/1973 | Ostertag | 297/142 |
| 3,964,713 | A * | 6/1976 | Joslyn et al. | 248/418 |
| 4,620,686 | A * | 11/1986 | Conant | 248/415 |
| 4,951,328 | A * | 8/1990 | Potvin | 4/560.1 |
| 6,899,385 | B2 * | 5/2005 | Pernicka et al. | 297/142 |
| 7,121,608 | B2 * | 10/2006 | Billger et al. | 296/65.06 |

* cited by examiner

*Primary Examiner* — Philip Gabler
(74) *Attorney, Agent, or Firm* — Gardner, Linn, Burkhart & Flory, LLP

(57) ABSTRACT

A swingable and pivotable seating system includes a base portion, a swing arm, a seat and a control system. The swing arm is pivotable about a generally vertical first pivot axis and has a first end pivotally mounted at the base portion and a second end opposite the first end. The seat is pivotally supported at or near the second end of the swing arm and pivotable about a generally vertical second pivot axis. The control system controls pivotal movement of the seat about the second pivot axis responsive to a degree of pivoting of the swing arm about the first pivot axis. The seating system may include a desk portion, and the control system may limit pivotal movement of the seat when the seat is near the desk portion and may allow greater pivotal movement of the seat when the seat is swung away from the desk portion.

21 Claims, 25 Drawing Sheets

PIVOTING SWING SEAT WITH CONTROL SYSTEM

CROSS REFERENCE TO RELATED APPLICATION

The present application claims the filing benefit of U.S. provisional application Ser. No. 61/498,774, filed Jun. 20, 2011, which is hereby incorporated herein by reference in its entirety.

FIELD OF THE INVENTION

The present invention relates to a pivotable and swingable seating assembly, such as for a lecture hall or the like, with a seat that is swingable to move away from a desk and that is pivotable to pivot about a generally vertical pivot axis relative to the desk.

BACKGROUND OF THE INVENTION

Swinging and pivoting seat assemblies for lecture halls and the like are known. Typically, the seats are pivotally mounted to a swing arm, which in turn is pivotally mounted to a base at a desk or table. Thus, pivotal movement of the swing arm relative to the base moves the seat towards and away from the desk or table, while the seat is freely pivotable relative to the end of the swing arm to allow for pivoting of the seat at the end of the swing arm to ease the user's ability to sit at the seat and/or to get up from the seat. However, because the seat is freely pivotable at the end of the swing arm, the seat often hits the edge of the desk or table, making noise and/or causing damage to either the seat or the desk or table.

SUMMARY OF THE INVENTION

The present invention provides a swing seat with a control arm or control system that limits or controls pivotal movement of the seat responsive to the position or location of the seat relative to the desk or table. For example, when the seat is swung to a fully in or stowed position, the seat may not be pivotable at the end of the swing arm so that its back rest (or a plane extending generally across the back rest) is facing and/or is generally parallel to and near to the edge of the desk or table, and as the seat is swung away from the desk or table, the seat is allowed to pivot at the end of the swing arm, with the degree of pivoting being related to the distance the seat is moved from the desk or table.

According to an aspect of the present invention, a swingable and pivotable seating system comprises a base portion, a swing arm, a seat and a control system. The swing arm has a first end pivotally mounted at the base portion and a second end opposite the first end, with the swing arm pivotable about a generally vertical first pivot axis at the base portion. The seat is pivotally supported at the second or distal end of the swing arm and is pivotable about a generally vertical second pivot axis. The control system controls pivotal movement of the seat about the second pivot axis responsive to or in accordance with a degree of pivoting of the swing arm about the first pivot axis.

The control system of the swingable and pivotable seating system may include a control arm and a control element or plate. The control arm has a first end pivotally mounted at the base portion and a second or distal end opposite the first end. The control arm is pivotable about a generally vertical third pivot axis, and the second end of the control arm is movably engaged with a portion of the swing arm distal from the first end of the swing arm. The control element is disposed at and pivotable with the seat about the second pivot axis, and a guide element or guide pin at the second end of the control arm engages the control element to control pivotal movement of the seat about the second pivot axis responsive to a degree of pivoting of the swing arm about the first pivot axis.

The control element may comprise a generally ring-shaped member or plate with a profile established along an inner surface of the ring-shaped member. The guide element moves within the control element or plate as the swing arm pivots about the first pivot axis so that the inner surface of the control element or plate limits movement of the guide element to limit pivotal movement of the seat about the second pivot axis.

The seating system may be disposed at a desk portion, with the base portion generally fixed relative to the desk portion. The swing arm thus may pivot about the first pivot axis to move the seat towards and away from the desk portion, with the swing arm moving the seat between a stowed position, where the seat is disposed generally at the desk portion, and an opened position, where the seat is moved away from the desk portion. For example, when in the stowed position, a seating portion of the seat may be disposed generally under or partially under the desk portion, while a back portion of the seat may be disposed generally along and facing the desk portion. The control element limits pivotal movement of the seat about the second pivot axis when the seat is at the stowed position, and may substantially preclude pivotal movement of the seat about the second pivot axis when the seat is at the stowed position. The control element may allow at least about 100 degrees, and preferably at least about 180 degrees (or more or less), of pivotal movement of the seat about the second pivot axis when the swing arm swings the seat to the opened position, such that the seat may pivot so as to face generally away from the desk portion. The control element controls pivotal movement of the seat about the second pivot axis to allow for varying degrees of pivotal movement between about zero degrees and at least about 180 degrees (or more or less) responsive to a degree of pivotal movement of the swing arm about the first pivot axis. The control element provides the control function via the shape or form of the inner surface profile, which limits pivotal movement of the seat as the guide element or pin (at the end of the control arm and movable along the swing arm) moves relative to the swing arm and relative to the pivot axis of the seat, as discussed in detail below.

Therefore, the present invention provides a seating system that allows for controlled swinging and pivoting movement of a seat relative to a base portion and/or desk portion. The seating system limits or substantially precludes pivotal movement of the seat when the seat is in its stowed position and generally at the desk portion, thus limiting or substantially precluding the seat from pivoting and hitting the edge of the desk, thereby reducing noise and potential damage to the seat or desk portion. The seating system also limits or substantially precludes over-pivoting of the seat as the seat is swung away from the desk portion, such as when a person is moving the seat away from the desk portion to either sit at the seat or get up from the seat. The present invention thus provides an enhanced seating system with enhanced control of the seat during storage of the seat, use of the seat and movement of the seat while a person is sitting down at the seat or getting up out of the seat.

These and other objects, advantages, purposes and features of the present invention will become apparent upon review of the following specification in conjunction with the drawings.

DESCRIPTION OF THE PREFERRED EMBODIMENTS

Figure 1:
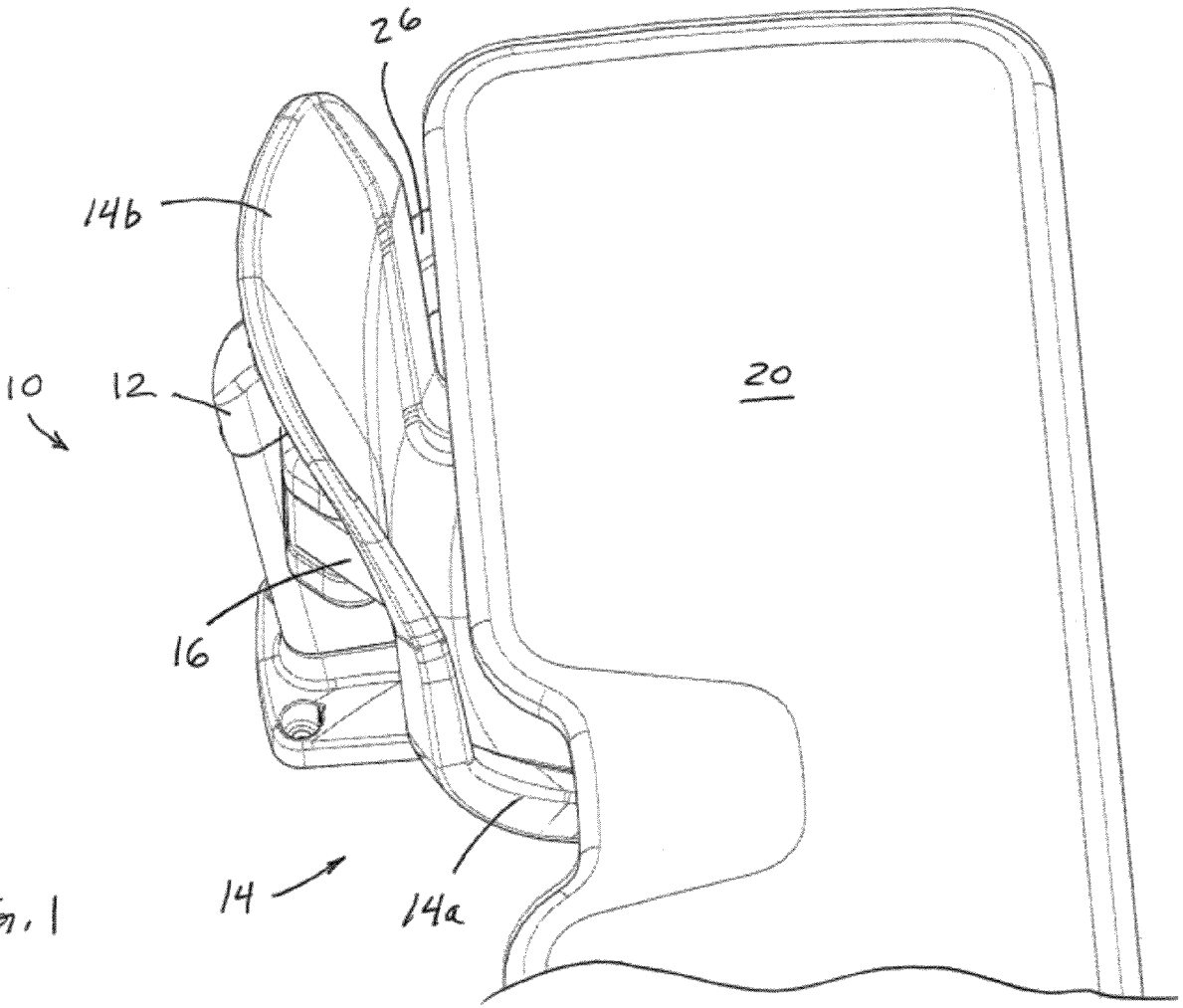
FIG. 1 is a perspective view of a pivoting and swinging seat assembly or system in accordance with the present invention, shown with the seat in a stowed position.
Figure 2:
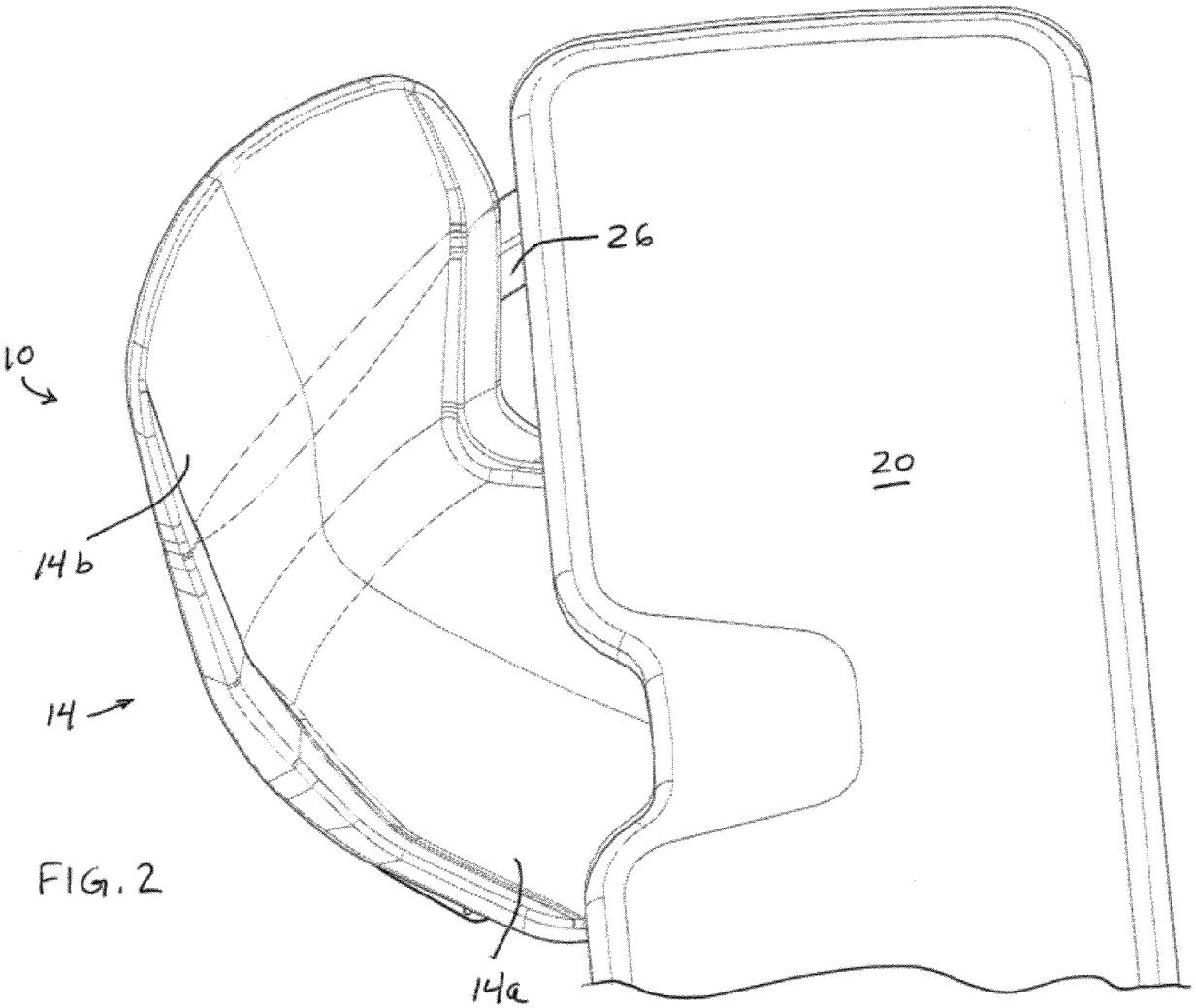
FIG. 2 is another perspective view of the seat assembly of FIG. 1, shown with the seat in a partially opened position.
Figure 3:
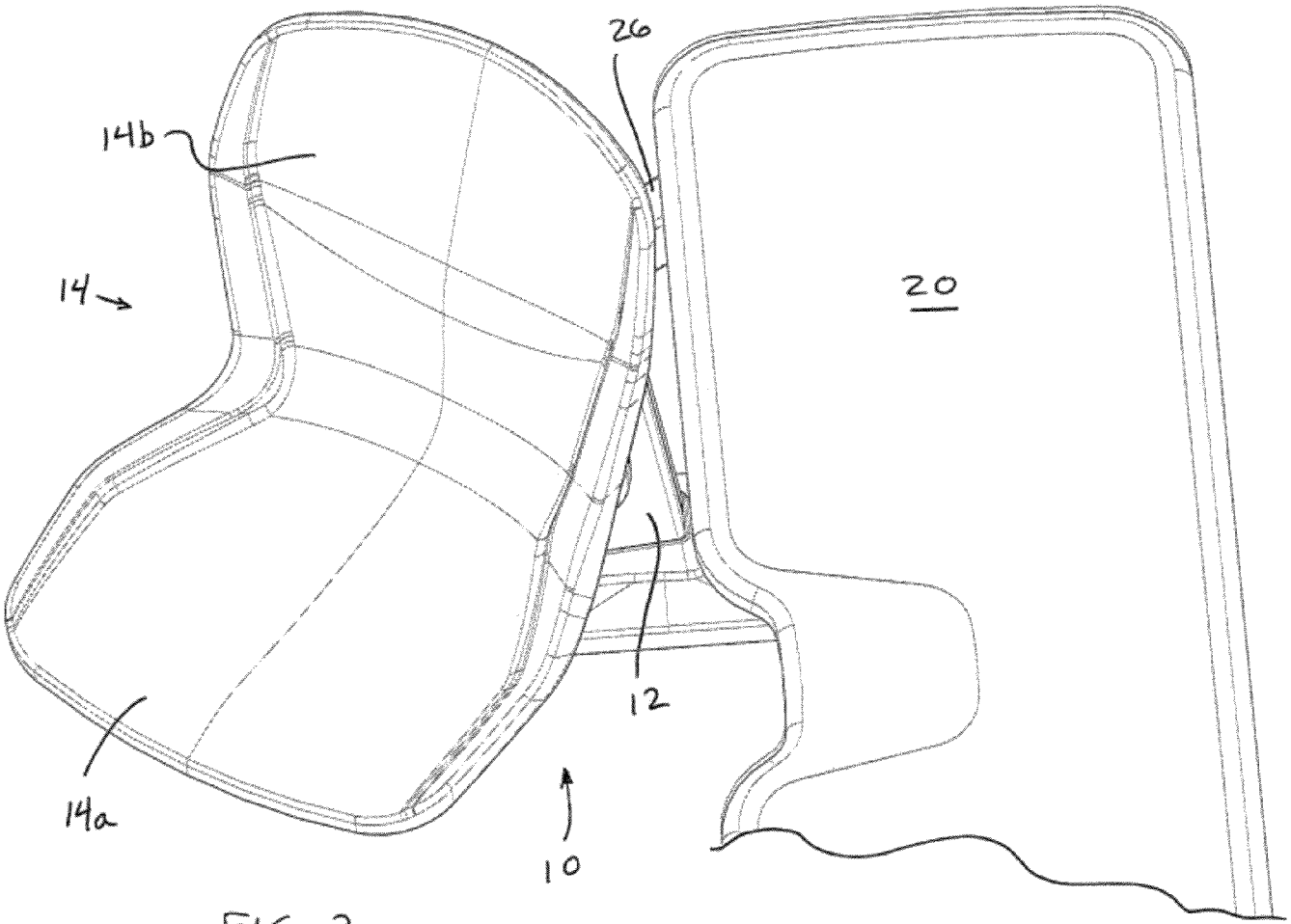
FIG. 3 is another perspective view of the seat assembly of FIGS. 1 and 2, shown with the seat in a further opened position.
Figure 4:
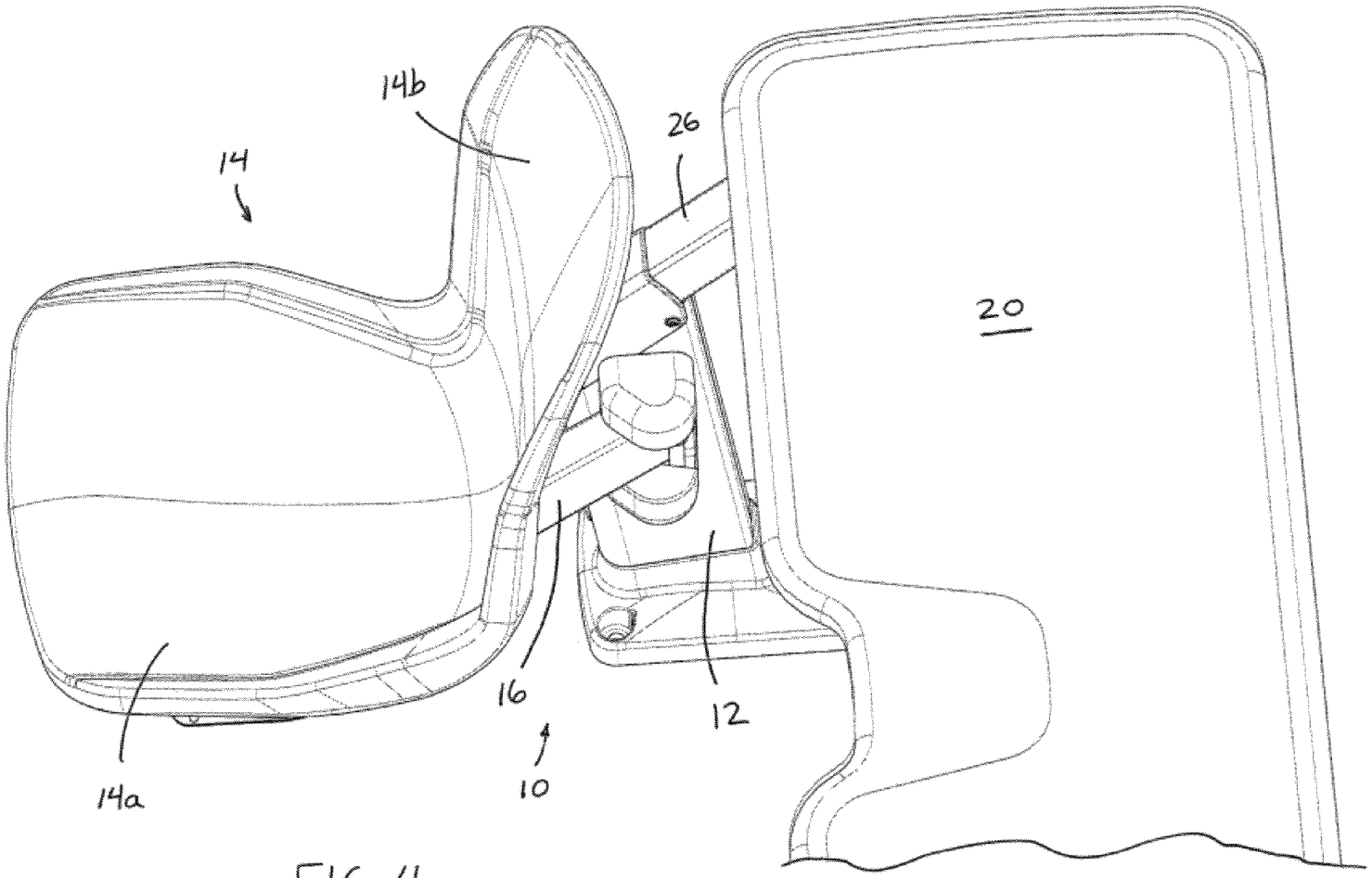
FIG. 4 is another perspective view of the seat assembly of FIGS. 1-3, shown with the seat in a fully opened position.
Figure 5:
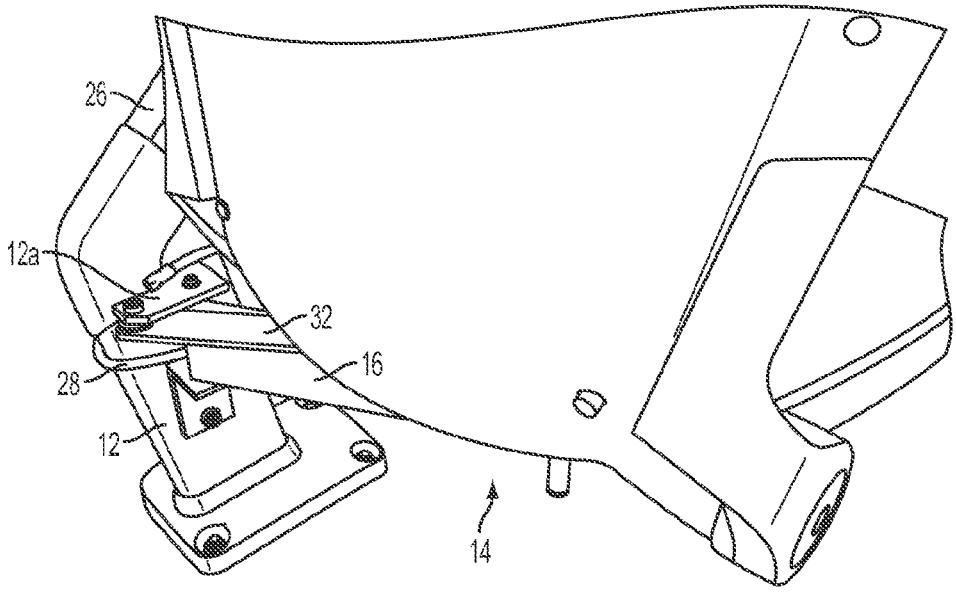
FIG. 5 is a perspective view of a base portion and swing arm and control arm of the seat assembly of FIGS. 1-4.
Figure 6:
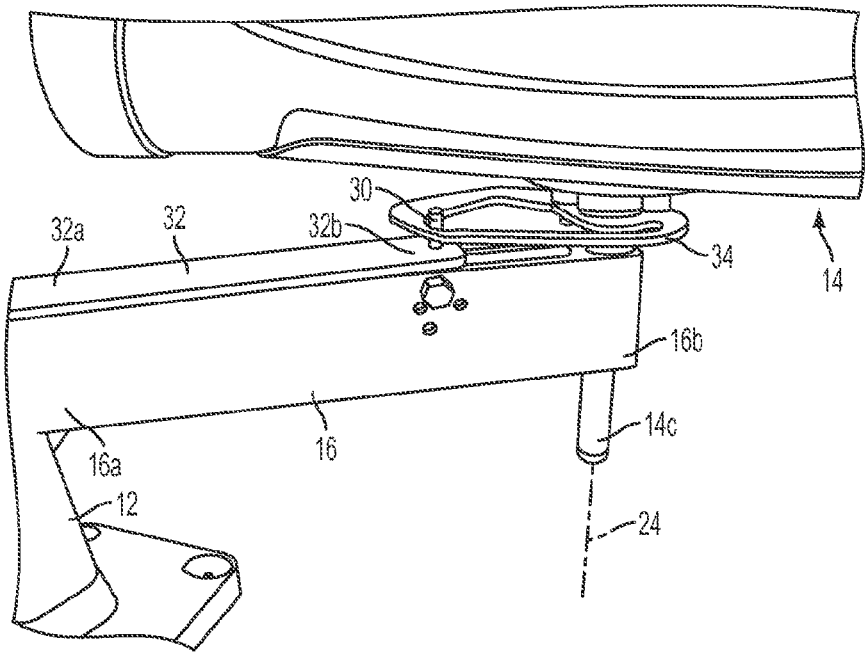
FIG. 6 is a perspective view of the swing arm and control arm and guide element of the seat assembly of FIG. 5.
Figure 7:
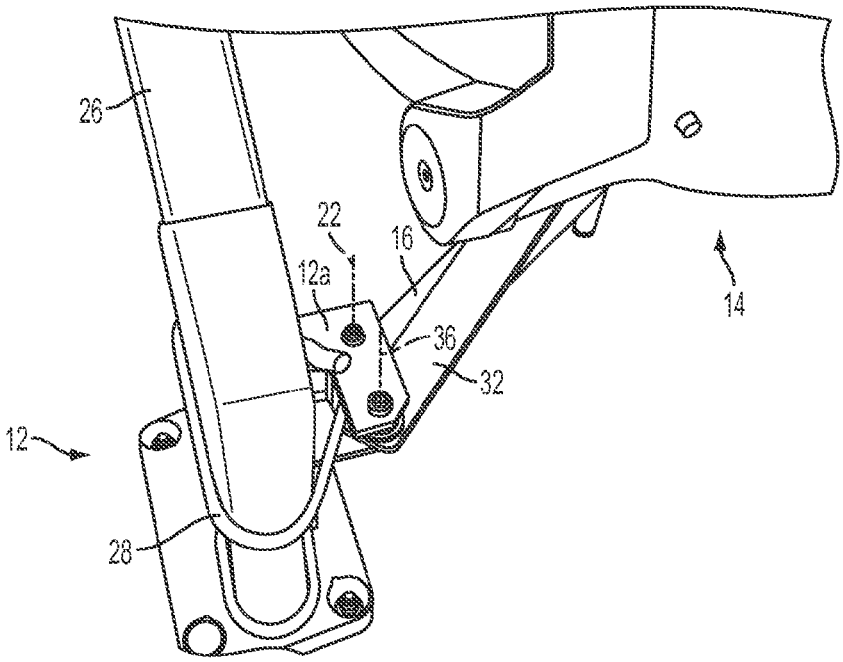
FIG. 7 is another perspective view of the base portion and swing arm and control arm of the seat assembly of FIG. 5.
Figure 8:
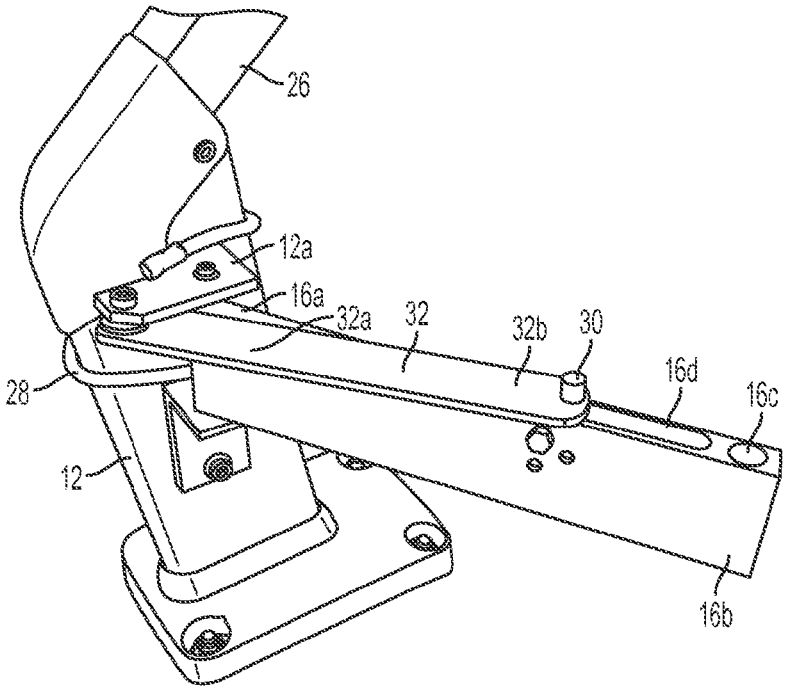
FIG. 8 is another perspective view of the base portion and swing arm and control arm of the seat assembly of FIG. 7, shown with the seat removed therefrom to show additional details.
Figure 9:
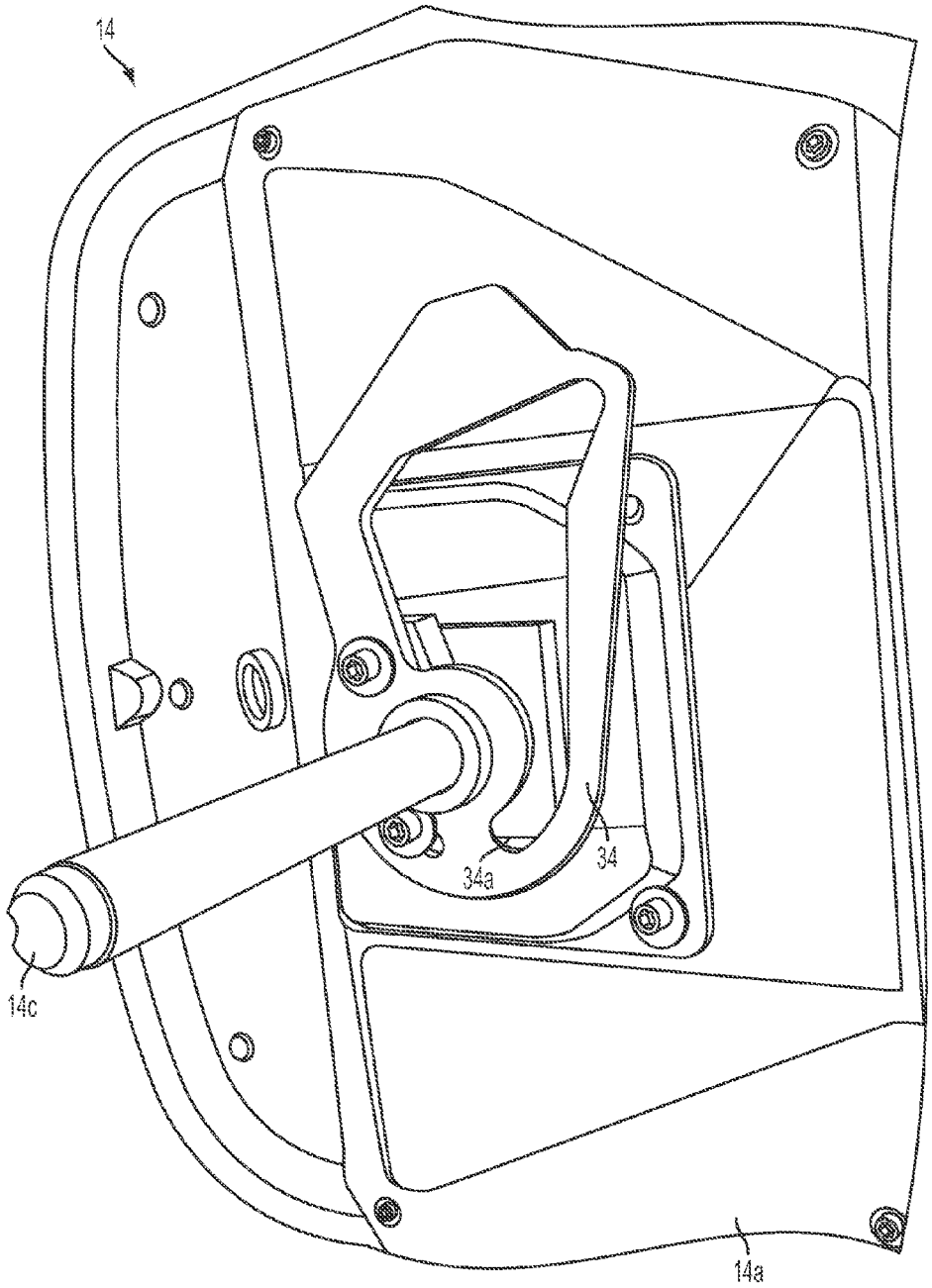
FIG. 9 is an underside perspective view of the seat, showing the guide element attached at the seat in accordance with the present invention.

Referring now to the drawings and the illustrative embodiments depicted therein, a seating system 10 includes a base portion 12 and a seat 14 that is movably or swingably mounted at the base portion 12 via a pivot arm or swing arm 16, with the seat 14 being pivotable at the end of the swing arm 16 and having its pivotal movement controlled via a control system 18 (FIGS. 1-9). The seating system 10 is disposed at a desk or table or desk portion 20, and the seat 14 is movable or swingable towards and away from the desk portion 20 via pivotal movement of the swing arm 16 about a first generally vertical pivot axis 22 (FIG. 7) at the base portion 12, so that the seat swings between a stowed position (with a seat base 14*a* disposed generally beneath or at the desk portion 20 and with a seat back 14*b* generally facing the desk portion 20, such as shown in FIG. 1) and a fully pulled out or opened position (with the seat 14 swung away from the desk portion 20 such as shown in FIG. 4). The control system 18 limits or controls pivotal movement of the seat 14 about a second generally vertical pivot axis 24 (FIG. 6) at an outer end of the swing arm 16 responsive to the degree of swinging of the swing arm about the first pivot axis 22, as discussed below. For example, the control system 18 may limit or substantially preclude pivotal movement of the seat 14 about the second pivot axis 24 when the seat is in its stowed position so that the seat back 14*b* of the seat does not or cannot contact the desk portion 20 (FIG. 1), while allowing at least about 100 degrees, and preferably at least about 180 degrees (or more or less), of pivotal movement of the seat 14 about the second pivot axis 24 when the seat is in its opened or pulled out position so that the seat can be pivoted to face away from the desk portion (FIG. 4), as also discussed below.

Seating system 10 is suitable for any seating configuration where it is desired to move the seat or swing the seat about a support structure while allowing for pivotal movement of the seat to facilitate turning the seat to face different directions. In the illustrated embodiment, seating system 10 is disposed at a desk portion 20, and may be suitable for use in lecture halls or other similar seating facilities, where students or the like may sit at the seat 14 and utilize the desk top or work surface or table of the desk portion 20, with the seat 14 being movable and pivotable to ease the user's ability to sit at the seat at the desk portion and get up from the seat at the desk portion. Seat 14 may comprise any suitable seat construction, typically having a seating portion 14*a* and a seat back or back rest 14*b*. Base portion 12 is fixed relative to a floor or support structure and is fixed relative to the desk portion 20, such as via a mounting arm 26, while swing arm 16 is pivotally mounted at base portion 12.

As best shown in FIGS. 5-8, a mounting end or base end 16*a* of swing arm 16 is pivotally mounted at base portion 12 (such as to a bracket 12*a* of base portion 12), with swing arm 16 extending outward from base portion 12 to a distal end or seat mounting end 16*b*. Distal end 16*b* of swing arm 16 is configured to pivotally mount seat 14, such as via a pivot pin or axle 14*c* (FIGS. 6 and 9) of seat 14 being received in a pivot hole or bushing 16*c* at distal end 16*b* of swing arm 16. The swing arm 16 may be generally freely pivotable about the first pivot axis 22, and optionally, and desirably, the swing arm 16 may be biased towards the stowed position via a biasing element 28 (although shown as an elastic band in FIGS. 5, 7 and 8, the biasing element may comprise a torsional spring or the like disposed at the mounting end 16*a* of swing arm 16 and mounting bracket 12*a* of base portion 12). The swing arm 16 includes a guide element or portion or slot 16*d* (such as a slot formed along the swing arm and towards the distal end of the swing arm), along which a guide element or pin 30 of a control arm 32 of control system 18 moves as the swing arm 16 pivots about the first pivot axis 22, as discussed below.

In the illustrated embodiment, control system 18 comprises control arm 32, which is pivotally mounted at base portion 12 (such as at bracket 12*a* of base portion 12) and which includes guide pin 30, and control system 18 comprises a guide element or control element or guide plate 34, which is mounted at or disposed at or established at seat 14 (such as at a mounting bracket 15 at an underside of the seat portion 14*a* of seat 14). Control arm 32 has a mounting end or base end 32*a* pivotally mounted at mounting bracket 12*a* of base portion 12 such that control arm 32 is pivotable about a third generally vertical pivot axis 36 (FIG. 7), with the third pivot axis 34 being spaced from or offset from and generally parallel to first pivot axis 22 of swing arm 16. Control arm 32 includes guide pin 30 at or near its distal end 32*b*, with guide pin 30 being movably or slidably received in slot or guide portion 16*d* of control arm 16. Thus, as swing arm 16 pivots about first pivot axis 22, control arm 32 also pivots about third pivot axis 36 and, because of the offset of the pivot axes 22, 36, guide pin 30 of control arm 32 moves along slot 16*d* of swing arm 16 to control pivotal movement of seat 14 about second pivot axis 24 via engagement of guide pin 30 with guide plate 34, as discussed below.

Figure 11:
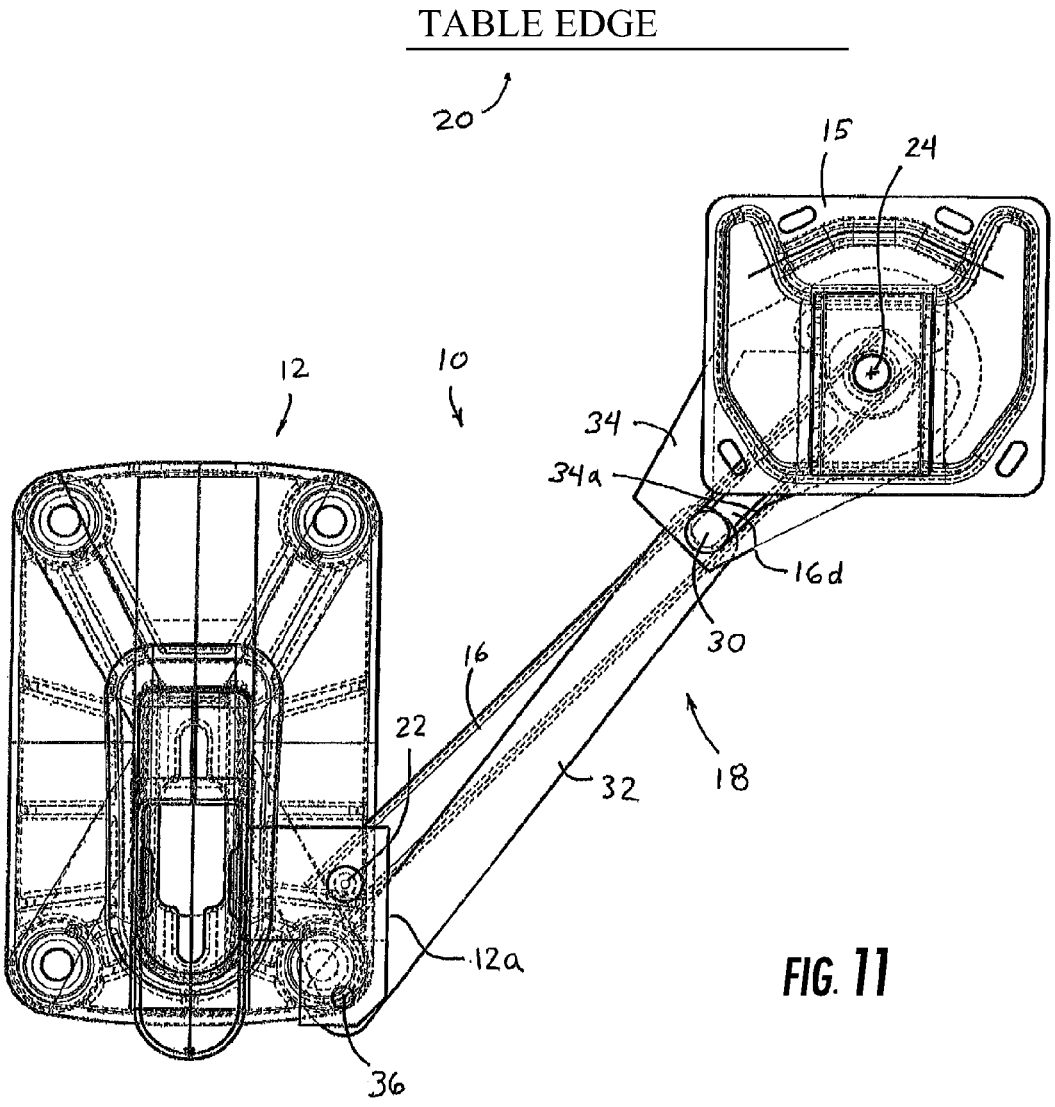
FIGS. 11-15 are top plan views of the base portion, swing arm, control arm and guide element of the seat assembly of the present invention, showing different degrees of pivotal movement of the swing arm relative to the base portion and of the seat and guide element relative to the swing arm and control arm.
Figure 12:
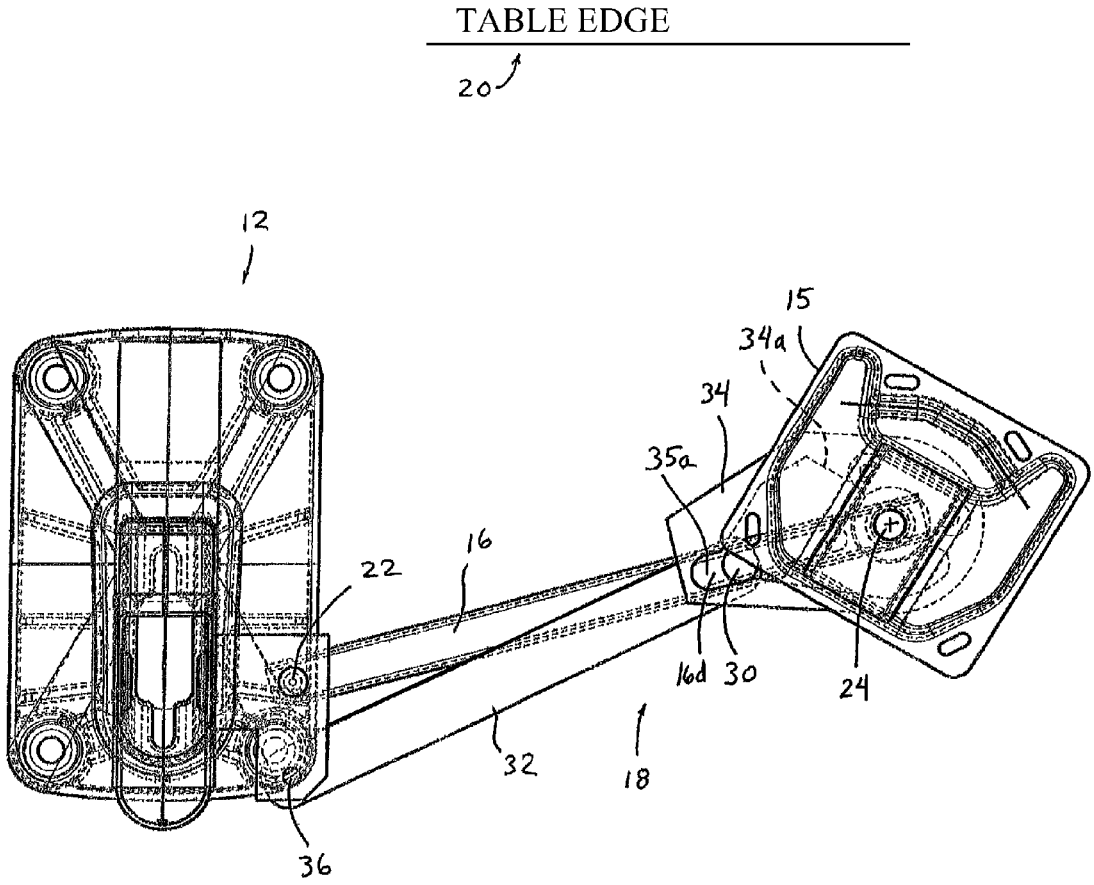

In the illustrated embodiment, the guide pin 30 at the distal end 32*b* of control arm 32 is received in guide element or plate 34 at seat 14. As shown in FIGS. 11 and 12, guide plate 34 may comprise a generally planar plate or generally ring-shaped plate or element attached at a central portion of seat portion 14*a* of seat and generally at and at least partially around pivot axle 14*c* of seat 14. Guide plate 34 has a guide shape or profile established therethrough such that an inner guide surface 34*a* of guide plate 34 is established along the profile to guide or limit movement of guide pin 30 relative to guide plate 34 and seat 14 during pivotal movement of seat 14 about second pivot axis 24 and swinging movement of swing arm 16 and seat 14 about first pivot axis 22.

The guide surface 34*a* of the shape or profile of the aperture or form of guide plate 34 functions to engage guide pin 30 to limit pivotal movement of guide plate 34 about pivot axis 24 via engagement of the guide surface 34*a* with guide pin 30, thereby limiting pivotal movement of seat 14 relative to swing arm 16, depending on or responsive to a degree of pivotal movement of the swing arm 16 about first pivot axis 22 and thus the degree of pivotal movement of the control arm 32 about third pivot axis 36 and corresponding movement of guide pin 30 along guide slot 16*d* of swing arm 16. Also, the engagement of the guide pin 30 with the swing arm 16 at the ends of the guide slot 16*d* limits the range of swinging motion of the swing arm 16 relative to the base portion 12.

Figure 13:
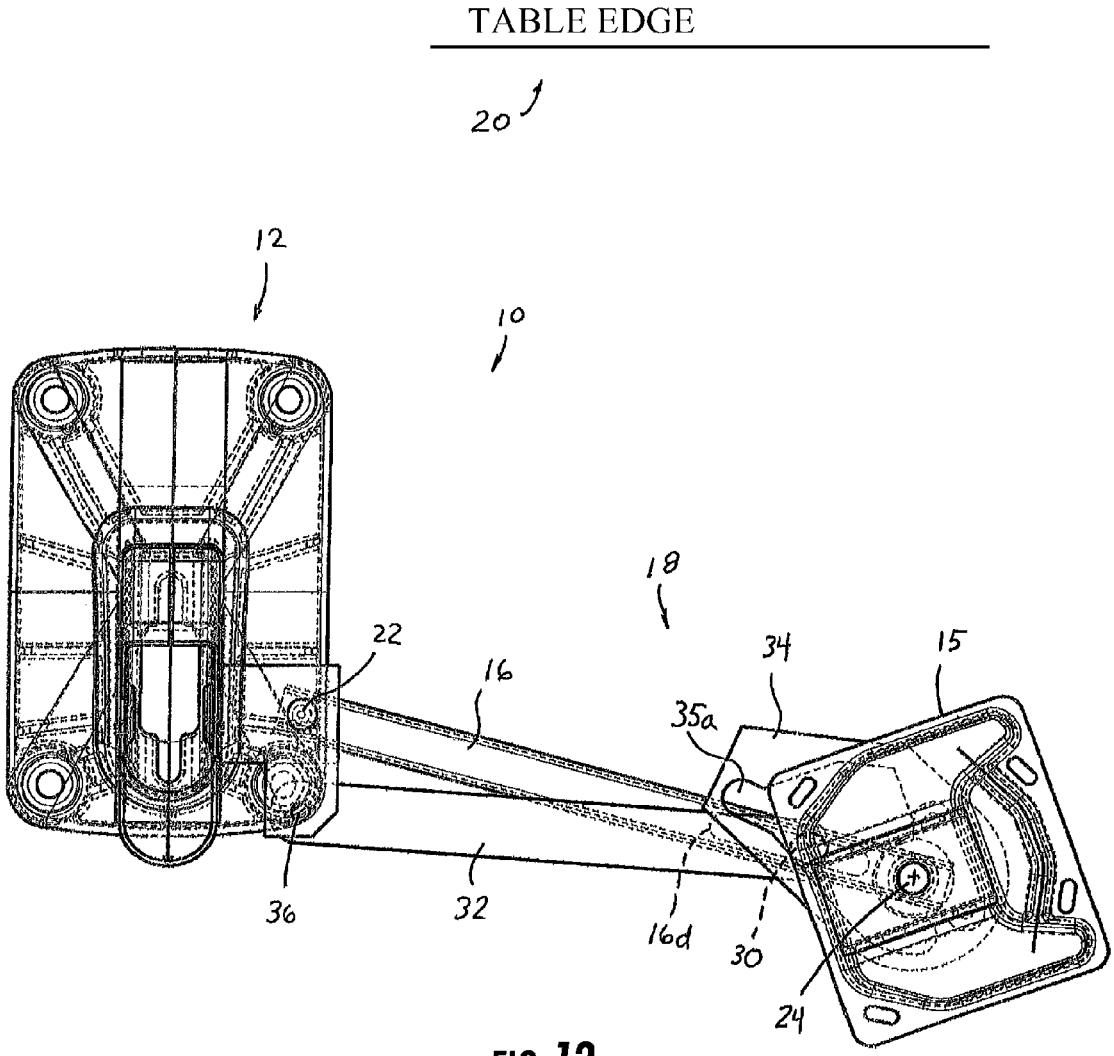
Figure 14:
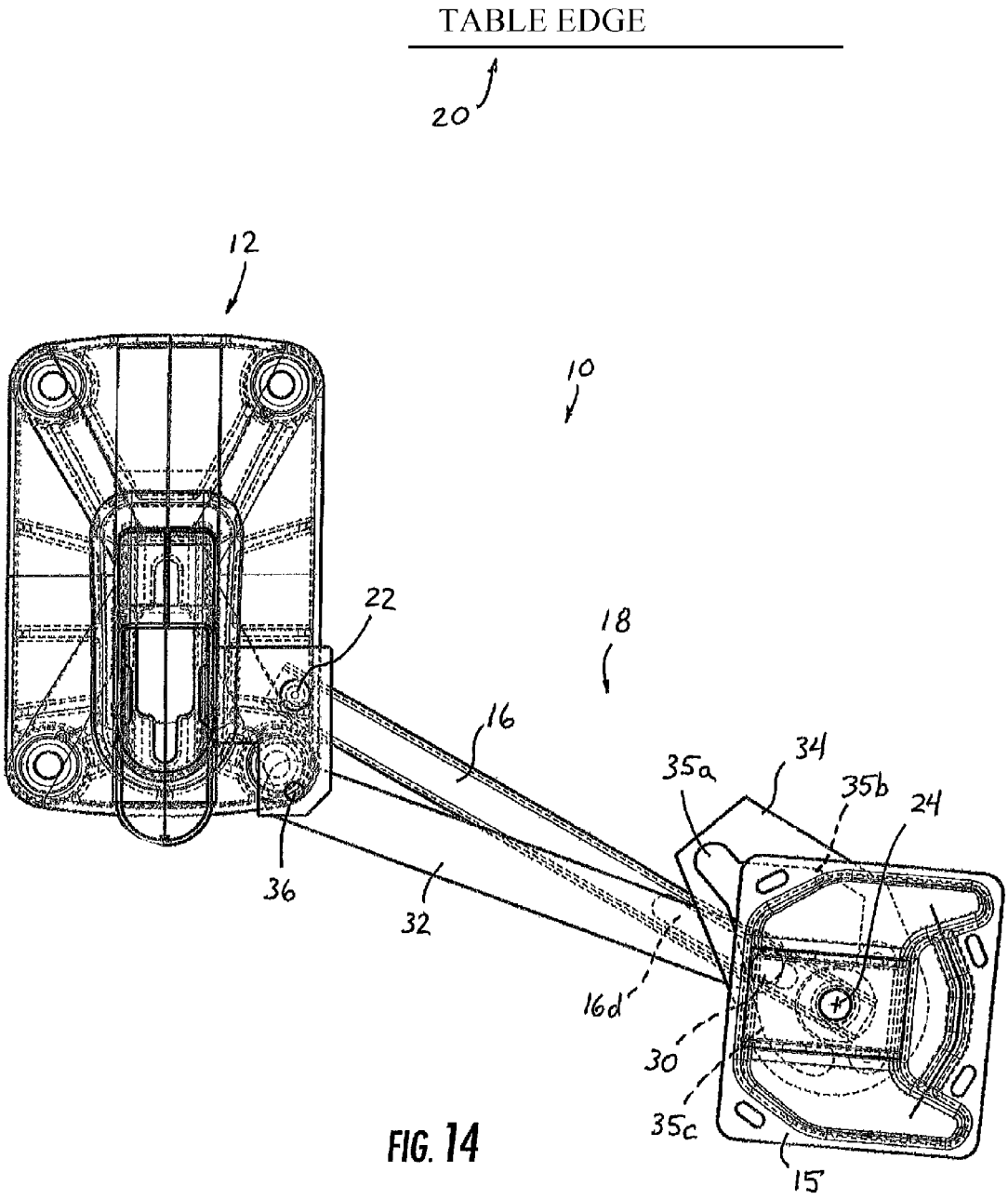
Figure 15:
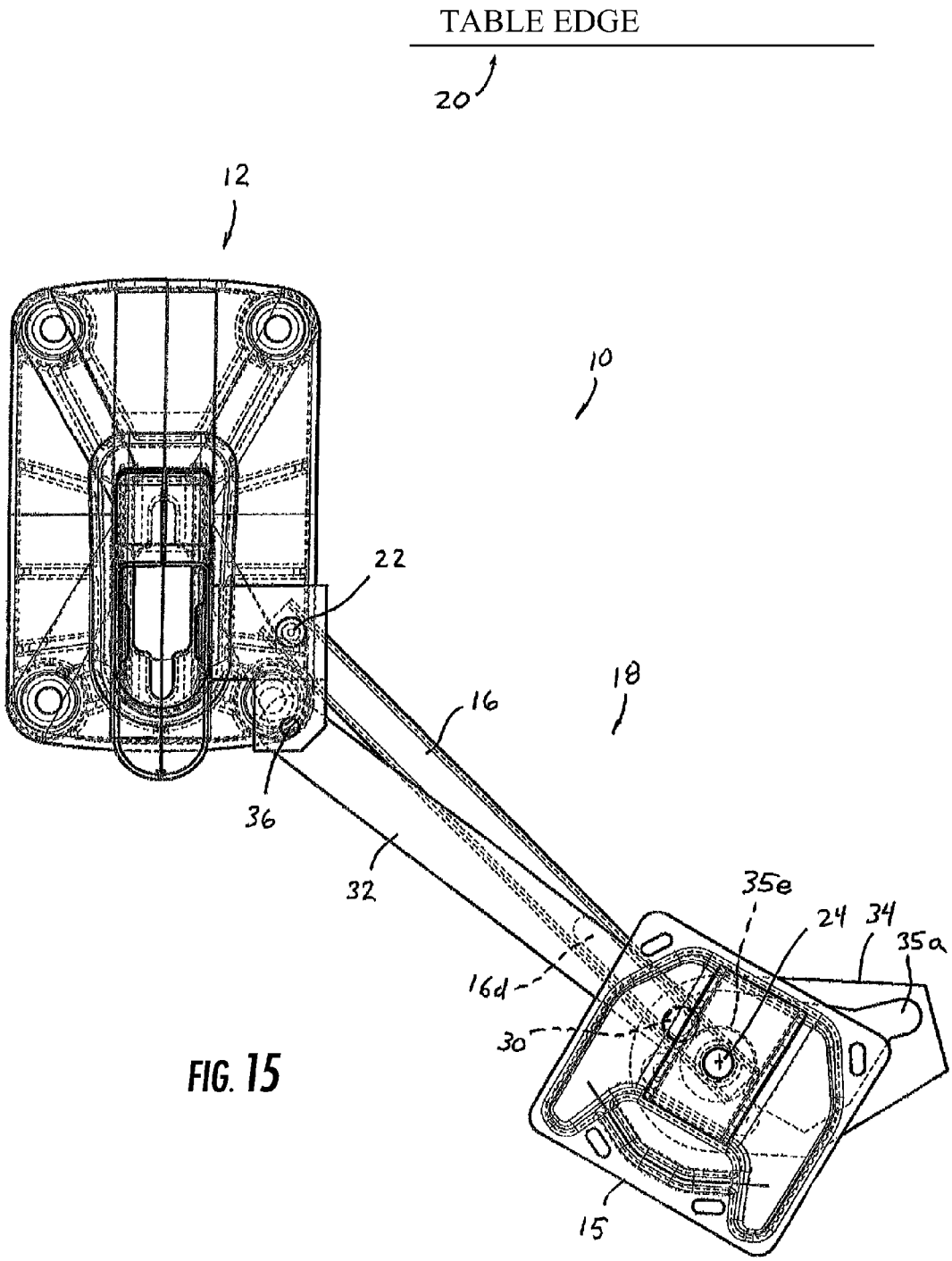

With reference to FIGS. 11-15, the control system 18 functions to control or limit pivotal movement of the seat 14 and mounting plate 15 and guide plate 34 about second pivot axis 24 and relative to swing arm 16, with the range of pivotal movement of the seat about the second pivot axis 24 being determined by or responsive to the degree of pivotal movement of the swing arm 16 about the first pivot axis 22. For example, the profile or contour of the inner surface 34*a* of guide plate 34 may be shaped to limit or substantially preclude pivotal movement of the seat about pivot axis 24 when the seat is in its stowed position (FIGS. 1 and 11), while allowing some pivotal movement of the seat away from the base portion 12 (such that the seat faces generally away from the base portion 12 to allow a person to sit at the seat) as the swing arm pivots or swings the seat away from the stowed position (FIGS. 12-14), and allowing at least about 100 degrees and preferably at least about 150 degrees and more preferably nearly or substantially or at least about 180 degrees, of pivotal movement of the seat about pivot axis 24 when the seat is swung fully away from the desk portion (FIG. 15).

Figure 10:
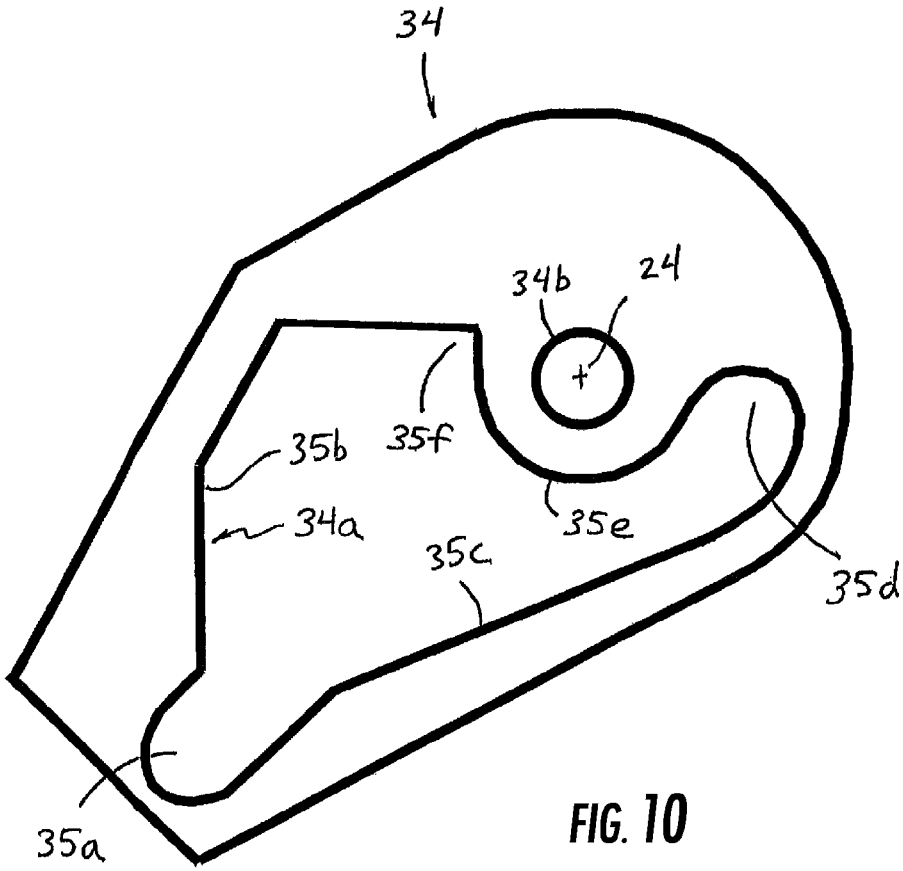
FIG. 10 is a plan view of a guide element or plate suitable for use with a control system of a seat assembly of the present invention.

More particularly, and with reference to FIG. 10, the profile or inner guide surface 34*a* of control or guide plate 34 is shaped to have a generally locking or pivot limiting portion 35*a*, an inward pivot limiting portion 35*b*, an outward pivot limiting portion 35*c* and an outermost pivot limiting portion 35*d*. Guide plate 34 also includes an aperture 34*b* for receiving pivot axle 14*c* therethrough when guide plate 34 is attached to seat 14 (such as via fasteners or the like to fixedly secure the guide plate relative to the seat). As can be seen with reference to FIGS. 12 and 13, locking or limiting portion 35*a* receives guide pin 30 therein when the seat is in its stowed position (FIGS. 1 and 11) to limit or substantially preclude pivotal movement of plate 34 (and thus seat 14) about second pivot axis 24 (via the pin 30 engaging either side of the slot-shaped pivot limiting portion 35*a*), such that the seat generally faces the desk portion with the seat back 14*b* facing or generally parallel to the desk portion (as shown in FIG. 11, the front edge of seat mounting plate 15 is generally parallel to the edge of the desk portion when the seat is in its stowed position). When the swing arm 16 is pivoted or swung to this inward position (with the seat in its stowed position), the guide pin 30 engages the swing arm at the end of the guide slot 16*d* to limit or substantially preclude further inward swinging of the swing arm 16 and seat 14 about pivot axis 22. Thus, when the swing arm 16 is pivoted or swung to this inward position, the seat 14 cannot be moved or swung further towards the desk portion and the seat cannot pivot about the second pivot axis, such that the seat back does not or cannot contact or strike the edge of the desk or table. Optionally, the proximate end of the slot 16*d* and/or the end of the locking portion 35*a* of plate 34 may have a resilient or cushioning or dampening feature established thereat to dampen or cushion the contact of the pin at the plate or arm when the seat is swung to its stowed state or position.

As the swing arm 16 pivots about first pivot axis 22 to move seat 14 away from the desk portion (FIG. 12), guide pin 30 may move along guide surface 34*a* and along and out of locking portion 35*a* to allow for limited pivotal movement of seat 14 relative to swing arm 16. Initial swinging movement of swing arm 16 from the stowed position may cause seat 14 to pivot slightly away from the base portion 12, such as shown in FIGS. 2 and 12, where seat mounting plate 15 is pivoted in a clockwise direction relative to the initial position in FIG. 11, as guide pin 30 moves along and out of portion 35*a* of guide surface 34*a* of guide plate 34. However, guide surface 34*a* of guide plate 34 limits pivotal movement of seat 14 about pivot axis 24 to a degree of pivoting that does not allow the seat back to contact desk portion 20 (in other words, the seat 14 can only pivot about its pivot axis 24 an amount that still provides clearance between the seat back 14*b* and the edge of the desk portion 20).

As swing arm 16 is swung or pivoted further about its pivot axis 22 (such as shown in FIG. 13), the seat may pivot further about its pivot axis 24, while guide pin 30 moves along slot 16*d* and may move along outward pivot limiting portion 35*c* of guide plate 34 (or may move along or engage inward pivot limiting portion 35*b* if the seat were pivoted in a counter-clockwise direction in FIG. 13). As can be seen with reference to FIG. 15, when the swing arm 16 is pivoted outward to this degree, the seat and seat bracket 15 may pivot in the counter-clockwise direction so that the seat generally faces the desk portion 20. When pivoted in such a manner, the guide pin 30 would engage guide surface 34*a* of guide plate 34 at or along the inward pivot limiting portion 35*b* of the guide plate 34 to limit or substantially preclude further counterclockwise pivoting of the seat beyond the position where the seat is generally facing the desk portion (such as would be desired by a person sitting at the seat and using the desk portion). Further pivotal movement of the swing arm 16 about pivot axis 22

(such as shown in FIGS. 3 and 14) allows for further outward pivoting of seat 14 as guide pin 30 may move further along guide surface 34*a* at outward pivot limiting portion 35*c* of guide plate 34 (with inward pivot limiting portion 35*b* limiting counterclockwise pivoting of the seat in a similar manner as above).

When the swing arm 16 is fully swung outwardly away from desk portion 20 (such as shown in FIGS. 4 and 15), the guide pin 30 engages swing arm 16 at the distal end of the guide slot 16*d* to limit further outward pivotal movement of the swing arm and thus of the seat 14 relative to the base portion and desk portion. When the swing arm is at this position, the guide pin 30 is received at the outermost pivot limiting portion 35*d* of guide plate 34, with the seat pivoted about its pivot axis 24 more than 180 degrees relative to its initial position (although the guide plate profile may otherwise limit the pivotal range of the seat to around 180 degrees or less than about 180 degrees while remaining within the spirit and scope of the present invention). Also, when the swing arm is in this position, the guide plate 34 allows for about 180 degrees of pivotal movement of the seat about its pivot axis 24 as the guide pin may move along an arcuate guide portion 35*e* of guide surface 34*a* of guide plate 34 to another inward pivot limiting portion 35*f*, which may limit or substantially preclude further pivotal movement of the seat 14 and guide plate 34 about pivot axis 24 when the seat is generally facing the desk portion 20 (or optionally facing partially away from the desk portion 20, depending on the particular shape and profile of the guide element or plate).

Although shown and described as a guide plate having the guide surface profile such as shown in FIG. 10, clearly other guide profiles may be implemented that limit or control pivotal movement of the seat about its pivot axis as the swing arm swings the seat relative to the base portion and desk portion, while remaining within the spirit and scope of the present invention. Also, although shown and described as having a guide plate and guide pin engagement to control or limit pivotal movement of the seat relative to the swing arm, clearly other means for limiting or controlling such pivotal movement responsive to the degree of pivotal movement or swinging of the swing arm about its pivot axis may be implemented, while remaining within the spirit and scope of the present invention. Optionally, instead of a sliding engagement between the pin and the inner wall or surface of the guide plate, a roller or other movable engagement means may be implemented while remaining within the spirit and scope of the present invention.

Figure 16:
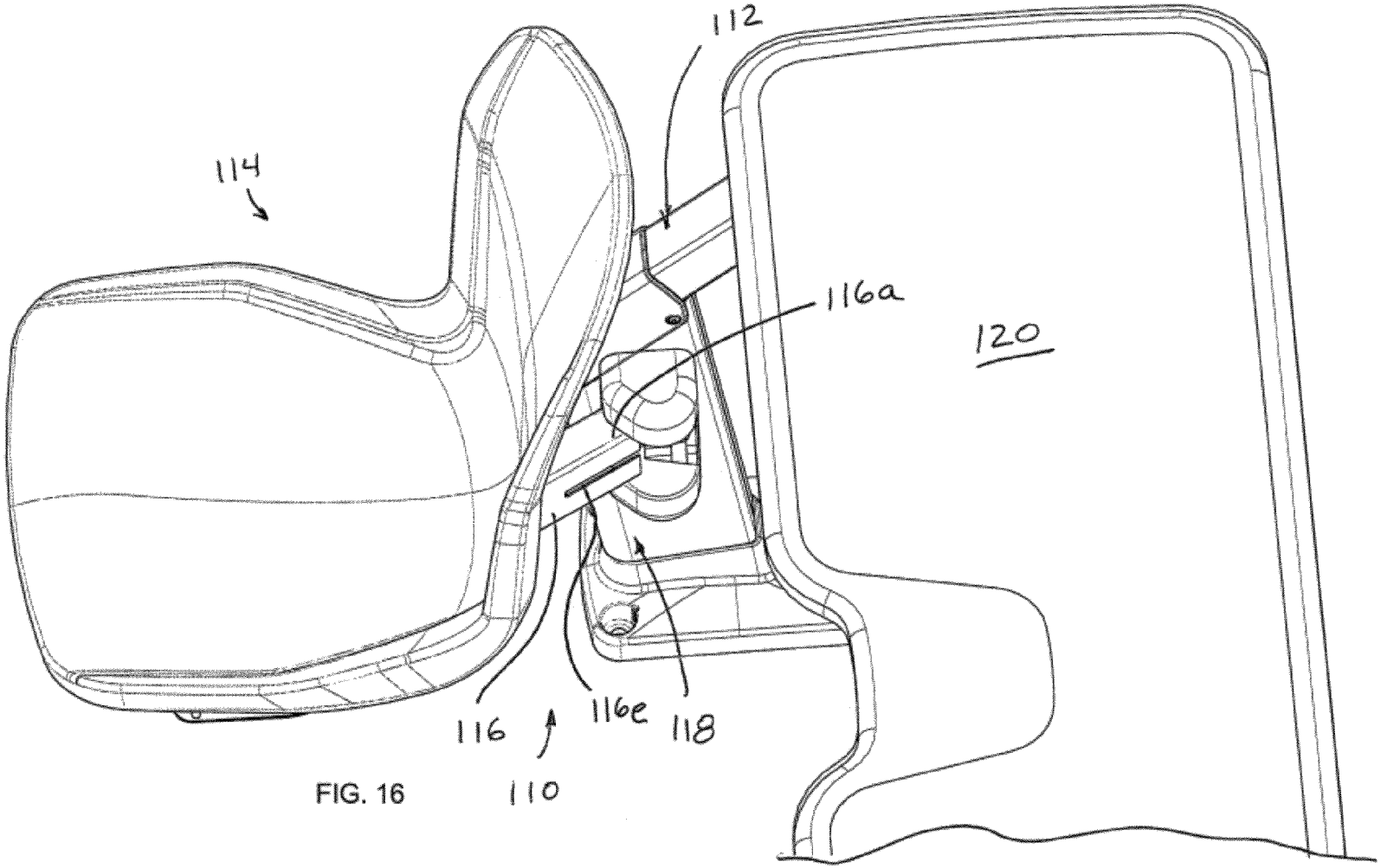
FIG. 16 is a perspective view of the seat assembly of the present invention, shown with the seat in a fully opened position.
Figure 17:
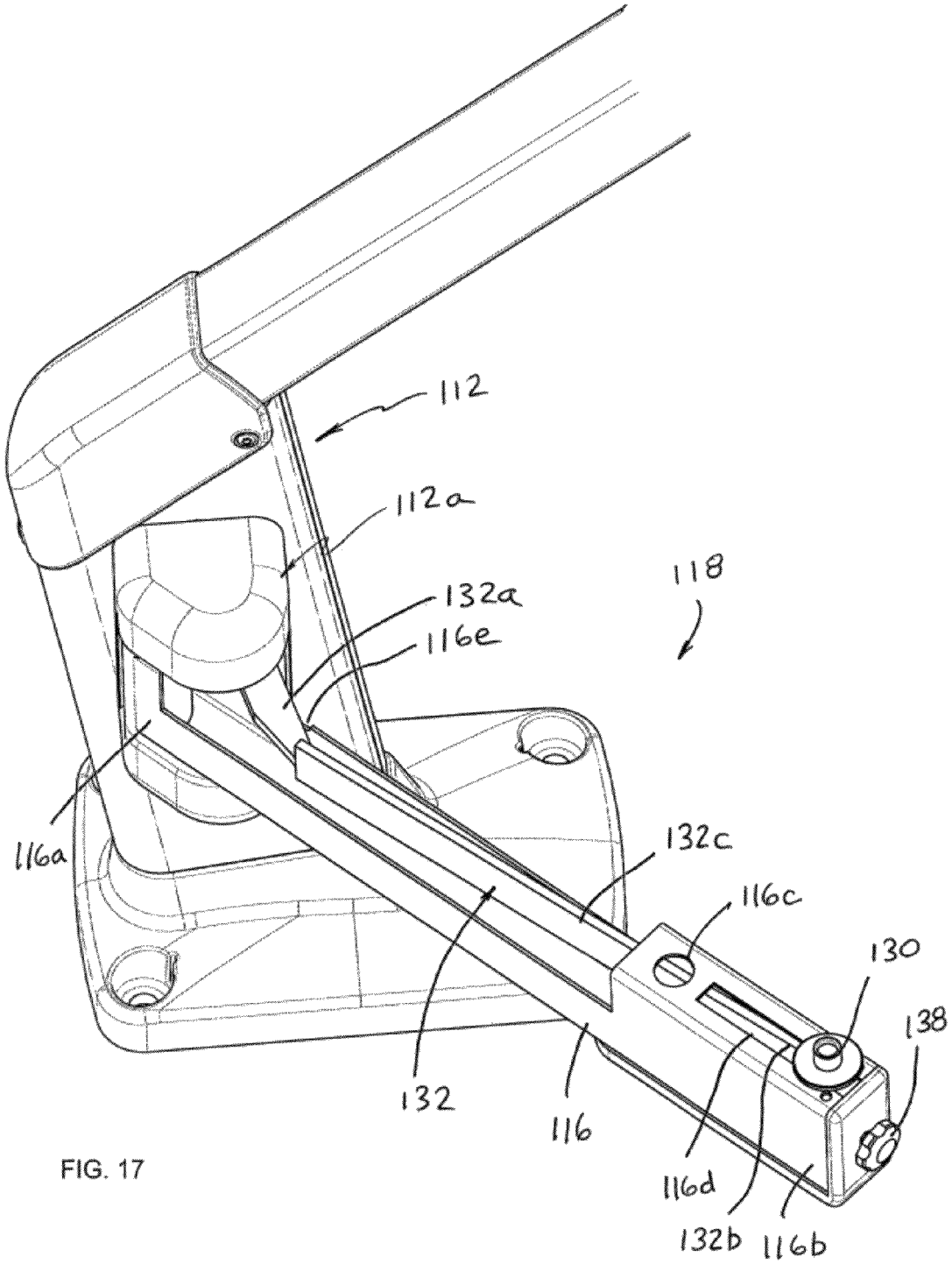
FIG. 17 is a perspective view of a base and a swing arm and a control arm for another pivoting and swinging seat assembly or system in accordance with the present invention.
Figure 18:
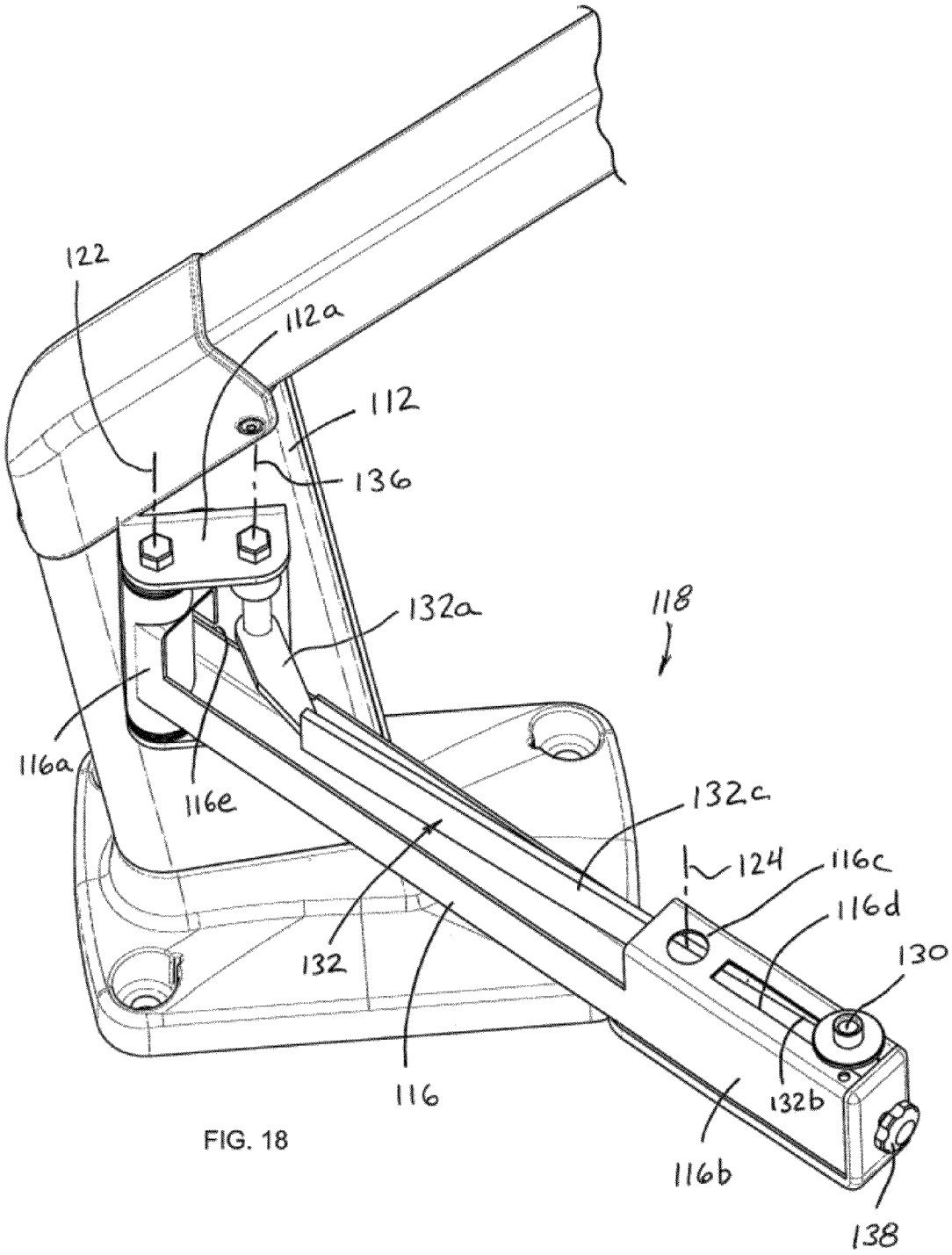
FIG. 18 is another perspective view of the base and swing arm and control arm of FIG. 17, with portions removed to show additional details.
Figure 19:
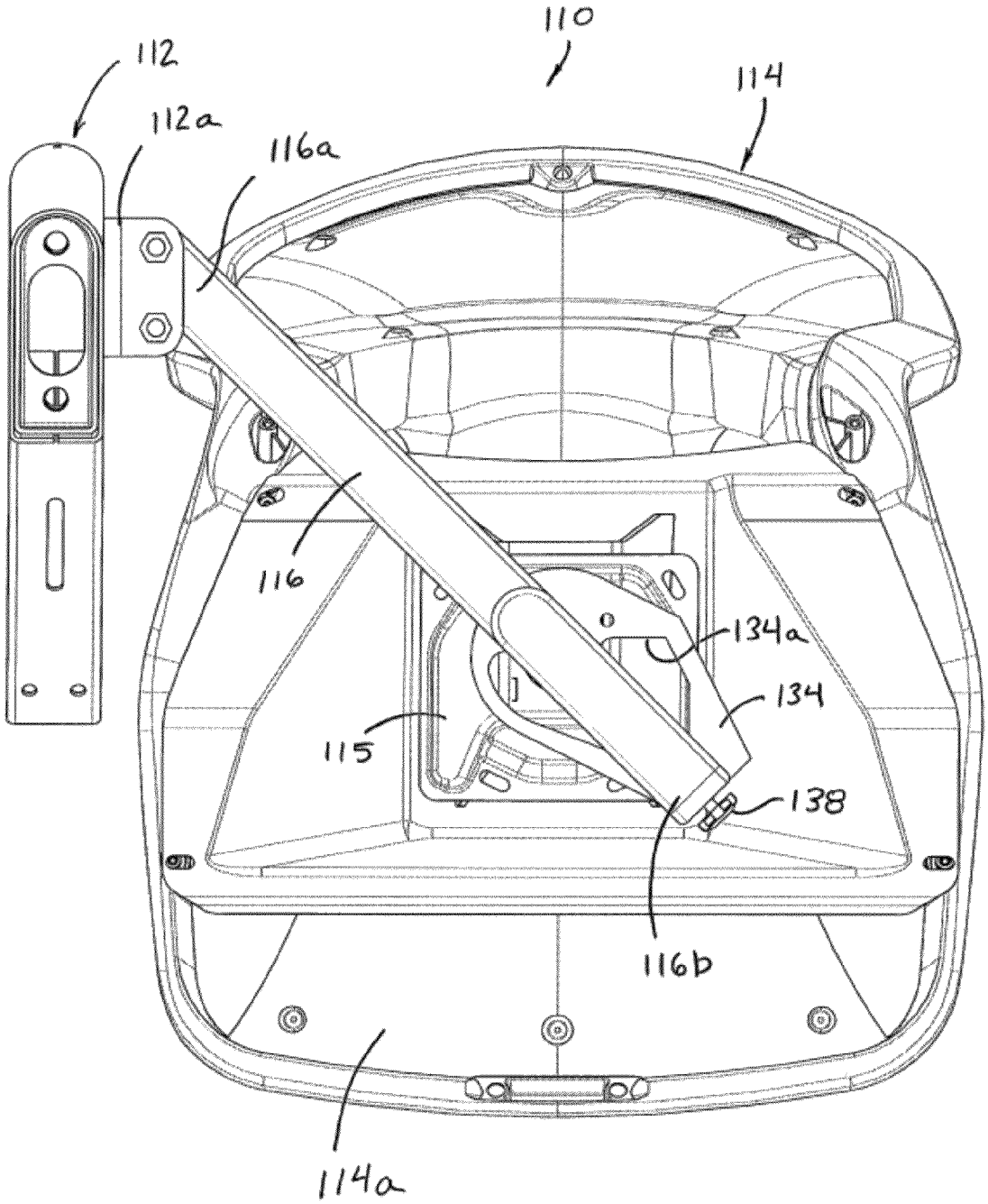
FIG. 19 is an underside view of the seat assembly of FIG. 16.

Also, although shown and described as having the control arm disposed outside of the swing arm and engaging a slot that is inboard of the pivot mount of the seat, clearly other configurations may be implemented to provide the desired control of the seat as it is swung and pivoted relative to the base and/or desk or table. For example, and with reference to FIGS. 16-27, a seating system 110 includes a base portion 112 and a seat 114 (such as a seat having a seat or base 114*a* and a seat back 114*b*) that is movably or swingably mounted at the base portion 112 via a pivot arm or swing arm 116, with the seat 114 being pivotable at the end of the swing arm 116 and having its pivotal movement controlled via a control system 118, such as in a similar manner as discussed above. As shown in FIG. 16, seating system 110 is disposed at a desk or table or desk portion 120, and the seat 114 is movable or swingable towards and away from the desk portion 120 via pivotal movement of the swing arm 116 about a first generally vertical pivot axis 122 at the base portion 112, so that the seat swings between a stowed position and a fully pulled out or opened position. The control system 118 limits or controls pivotal movement of the seat 114 about a second generally vertical pivot axis 124 at an outer end of the swing arm 116 responsive to the degree of swinging of the swing arm about the first pivot axis 122, such as in a similar manner as discussed above. Seating control system 118 may be similar in construction and function as seating control system 18, discussed above, such that a detailed discussion of the seating control systems need not be repeated herein.

In the illustrated embodiment, swing arm 116 comprises an elongated hollow member or tube, with a mounting end or base end 116*a* of swing arm 116 pivotally mounted at base portion 112 (such as to a bracket 112*a* of base portion 112), and with swing arm 116 extending outward from base portion 112 to a distal end or seat mounting end 116*b*. Swing arm 116 is configured to pivotally mount seat 114, such as via a pivot pin or axle 114*c* of seat 114 being received in a pivot hole or bushing 116*c* near the distal end 116*b* of swing arm 116. Similar to swing arm 16, swing arm 116 may be generally freely pivotable about the first pivot axis 122, and may be biased towards the stowed position. The swing arm 116 includes a guide element or portion or slot 116*d* (such as a slot formed along the swing arm and at or near the distal end of the swing arm), along which a guide element or pin 130 of a control arm 132 of control system 118 moves as the swing arm 116 pivots about the first pivot axis 122.

Swing arm 116 is configured to receive control arm 132 therein, and includes an outer slot 116*e* (FIG. 16) established at the base end 116*a* of swing arm 116 for receiving a portion of the control arm 132 therethrough. Control arm 132 comprises an elongated rod or member that is pivotally mounted at base portion 112 (such as at bracket 112*a* of base portion 112) and that includes guide pin 130 for engaging a guide element or control element or guide plate 134 mounted at or disposed at or established at seat 114 (such as at a mounting bracket 115 at an underside of the seat portion 114*a* of seat 114). Control arm 132 has a generally flattened mounting end or base end 132*a* pivotally mounted at mounting bracket 112*a* of base portion 112 such that control arm 132 is pivotable about a third generally vertical pivot axis 136, with the third pivot axis 136 being spaced from or offset from and generally parallel to first pivot axis 122 of swing arm 116. Control arm 132 includes guide pin 130 at or near its distal end 132*b*, with guide pin 130 being movably or slidably received in slot or guide portion 116*d* of control arm 116. Thus, and in a similar manner as discussed above, as swing arm 116 pivots about first pivot axis 122, control arm 132 also pivots about third pivot axis 136 and, because of the offset of the pivot axes 122, 136, guide pin 130 of control arm 132 moves along slot 116*d* of swing arm 116 to control pivotal movement of seat 114 about second pivot axis 124 via engagement of guide pin 130 with guide plate 134.

Figure 20:
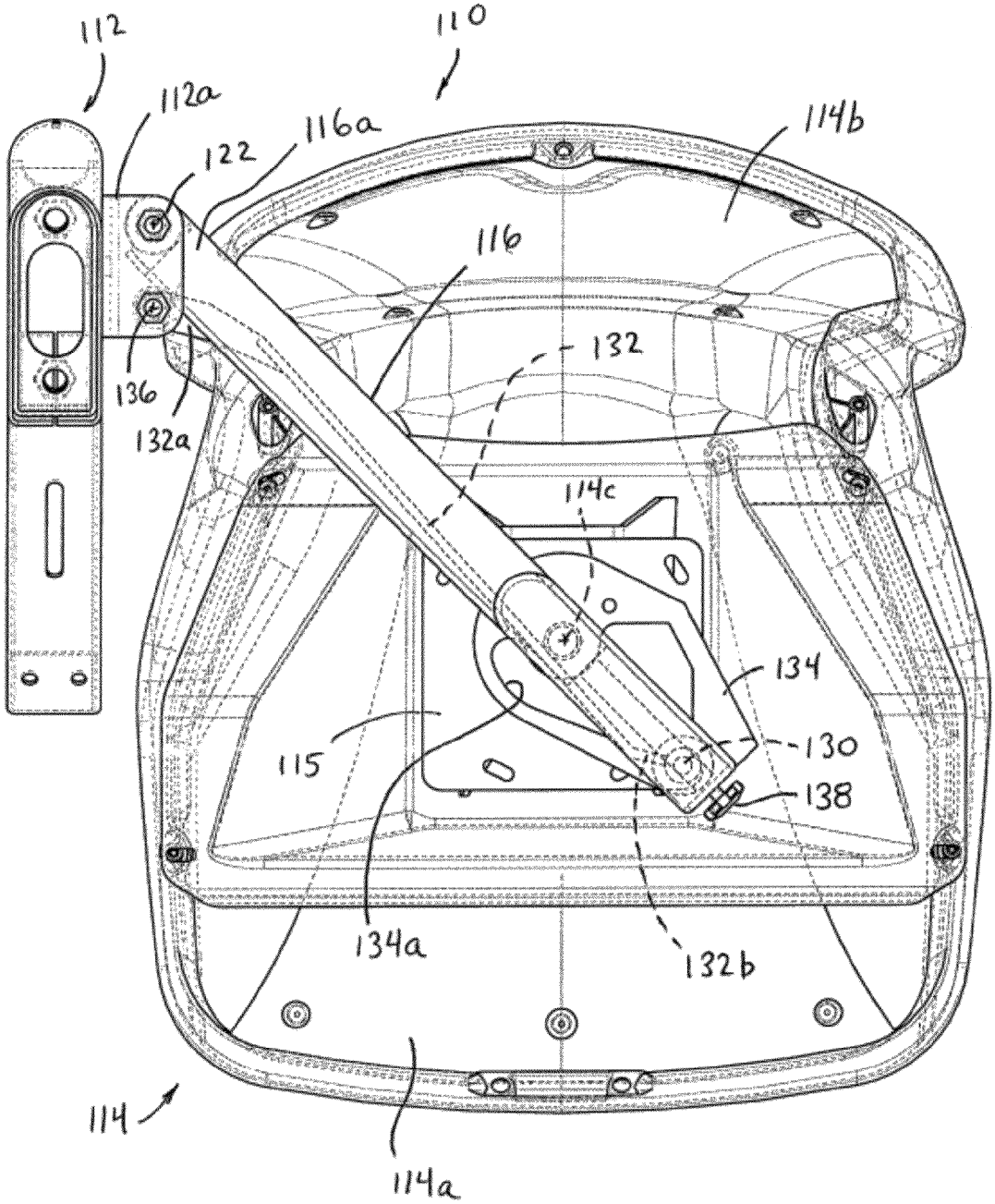
FIG. 20 is another underside view of the seat assembly of FIG. 16.
Figure 21:
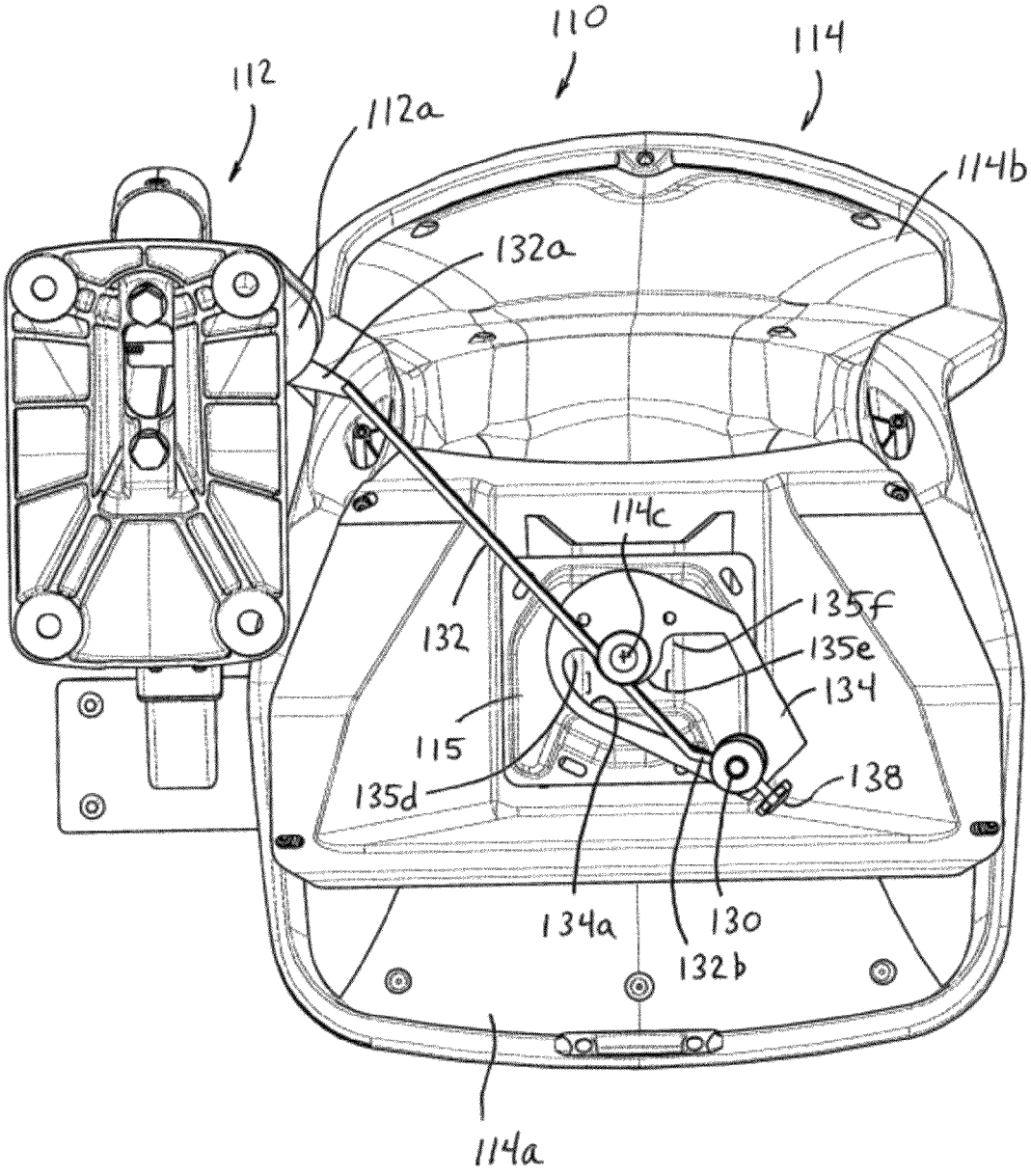
FIG. 21 is another underside view of the seat assembly of FIG. 16, with the swing arm removed to show additional details.
Figure 22:
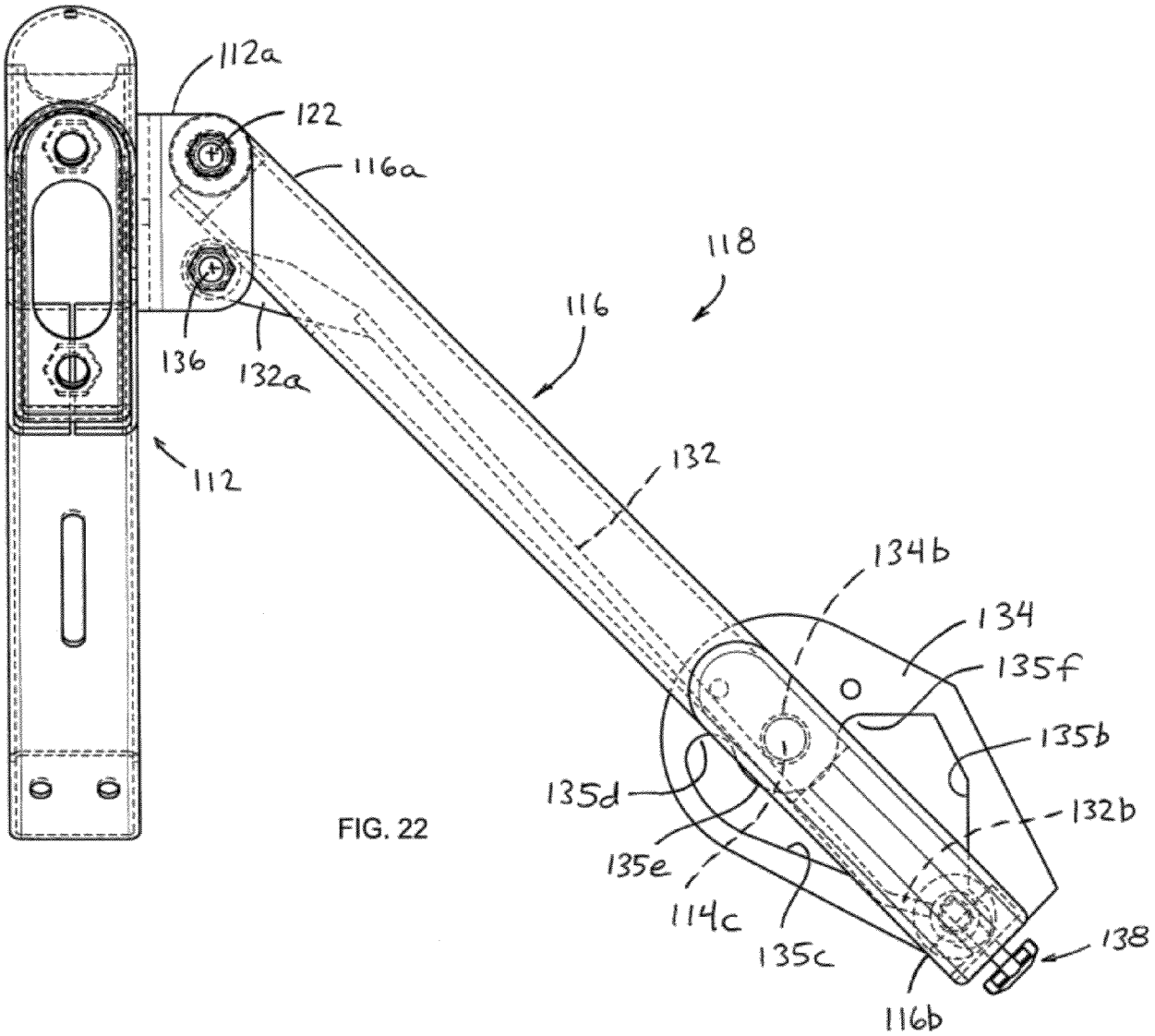
FIG. 22 is an underside view of the control system of the seat assembly of FIGS. 16, 19 and 20.

In the illustrated embodiment, the control arm is configured to be received in and along the swing arm 116 to limit exposure of the control arm at the completed seat assembly. The generally flattened base end 132*a* of control arm 132 passes through the slot 116*e* of swing arm 116, whereby the slot allows for pivotal movement of swing arm 116 and control arm 132, without interference between the control arm and swing arm. Control arm 132 includes an elongated portion 132*c* that extends from flattened base end portion 132*a* and generally along and within swing arm 116. As shown in FIGS. 20-22, control arm 132 is configured to be disposed generally along a sidewall of the swing arm 116 and beyond pivot pin or axle 114*c* of the seat 114, and has a curved or bent distal end portion 132*b* that curves towards the slot 116*d* of swing arm 116, which receives the guide pin 130 at the distal end 132*b* of control arm 132 (and radially outboard of pivot axle 114*c* of seat 114).

Similar to the control system discussed above, the guide pin 130 at the distal end 132*b* of control arm 132 is received in guide element or plate 134, which is generally fixedly attached at seat 114. Guide plate 134 may comprise a generally planar plate or generally ring-shaped plate or element attached at a central portion of seat portion 114*b* of seat and generally at and generally at or at least partially around pivot axle 114*c* of seat 114. Guide plate 134 has a guide shape or profile established therethrough such that an inner guide surface 134*a* of guide plate 134 is established along the profile to guide or limit movement of guide pin 130 relative to guide plate 134 and seat 114 during pivotal movement of seat 114 about second pivot axis 124 and swinging movement of swing arm 116 and seat 114 about first pivot axis 122, such that pivotal movement of seat 114 about pivot axis 124 is limited or controlled responsive to the pivotal movement or degree of pivotal movement or orientation of the swing arm about pivot axis 122.

Because the control arm pivot axis 136 is disposed between the desk and the swing arm pivot axis 122 (as opposed to the control arm pivot axis 36 being disposed at an opposite side of the swing arm pivot axis 22 from the desk for control system 18, discussed above) and with the slot 116*d* of swing arm 116 is disposed radially outboard of the pivot axis 124, the guide or control plate 134 is flipped or reversed as compared to guide or control plate 34 (as can be seen by comparing FIGS. 23-27 with FIGS. 11-15), but otherwise the profile of control plate 134 may be generally similar to the profile of guide plate 34, discussed above. Also, by having the slot 116*d* of swing arm 116 disposed at or near the end of the swing arm, the control system 118 may include an adjustment mechanism or stop 138 at the outer or distal end 116*b* of the swing arm 116. The adjustment mechanism 138 is manually adjustable to adjust the end stop of the pivot locking or limiting portion 135*a* of the profile 134*a* of guide plate 134. In the illustrated embodiment, the adjustment mechanism 138 comprises a threaded set screw or adjustment knob, which is threaded into a threaded bore at the end 116*b* of the swing arm 116 and may be threaded further into the swing arm to shorten stop location or threaded out of the swing arm to lengthen or extend the stop location. Although shown as having a knob at the end for a user to adjust, it is envisioned that the adjustment mechanism may comprise a threaded set screw that can be adjusted with the appropriate tool (and not readily adjusted by a person without the appropriate tool), such that the end stop may be set or adjusted at the time of installation of the seating assembly or system and not readily adjusted or misadjusted after the seating system installation is completed.

Thus, the adjustment mechanism may be adjusted to set the stop location so that the swing arm pivots to a particular or selected fully stowed or non-use position. The adjustment mechanism may be adjusted so that the seat assembly, when in its fully stowed position, has a desired gap or separation distance between the seat back and the desk or table top. For example, when the seat assembly is installed at a desk, if the seat back contacts the desk when the seat is in its stowed position, the installation operator may adjust the adjustment screw or mechanism (such as by threading the set screw inward into the swing arm) so that movement of the pin 130 along slot 116*d* is limited ore reduced by the end 138*a* of the adjustment mechanism or set screw 138 to establish or increase the gap between the seat back and the desk so that the seat back does not contact the desk when the seat is in its fully stowed position. If the adjustment mechanism is adjusted to its fully retracted or unthreaded state, then pivotal movement of the swing arm is limited when the pin 130 either contacts the end of slot 116*d* of swing arm 116 or contacts the profile wall of the guide plate at the end of the pivot locking or limiting portion 135*a* of the profile 134*a* of guide plate 134. Optionally, the end 138*a* of the adjustment mechanism may comprise a resilient or cushioning or dampening feature (such as a rubber element at the end 138*a*) to dampen or cushion the contact of the pin at the adjustment mechanism when the seat swings to its stowed position. Similarly, and optionally, the distal end of the slot 116*d* and/or the distal end of the locking portion 135*a* of plate 134 may have a resilient or cushioning or dampening feature established thereat to dampen or cushion the contact of the pin at the plate or arm when the seat is swung to its stowed state or position.

Optionally, although shown and described as comprising a threaded adjustment mechanism at the end of the swing arm, the adjustment device or mechanism may comprise any suitable means for selectively or adjustably limiting movement of the pin 130 along the slot 116*d* at or near the end of the swing arm 116. Also, although shown and described as being at the end of the swing arm, the adjustment mechanism may be otherwise disposed at the swing arm, such as at the inboard end of the slot 16*d* of swing arm 16, while remaining within the spirit and scope of the present invention. The adjustable stop thus functions to limit or stop movement of the pin 130 at the end of the control arm in the radially outward direction as the swing arm is pivoted towards the stowed position (and towards the pivot axis of the control arm), which in turn limits the pivotal movement of the swing arm in that direction. The seating system of the present invention thus provides an adjustable stop that limits the pivotal range of the swing arm at the seat's stowed position by adjusting where the stop or movement limiter is located along the swing arm.

Figure 23:
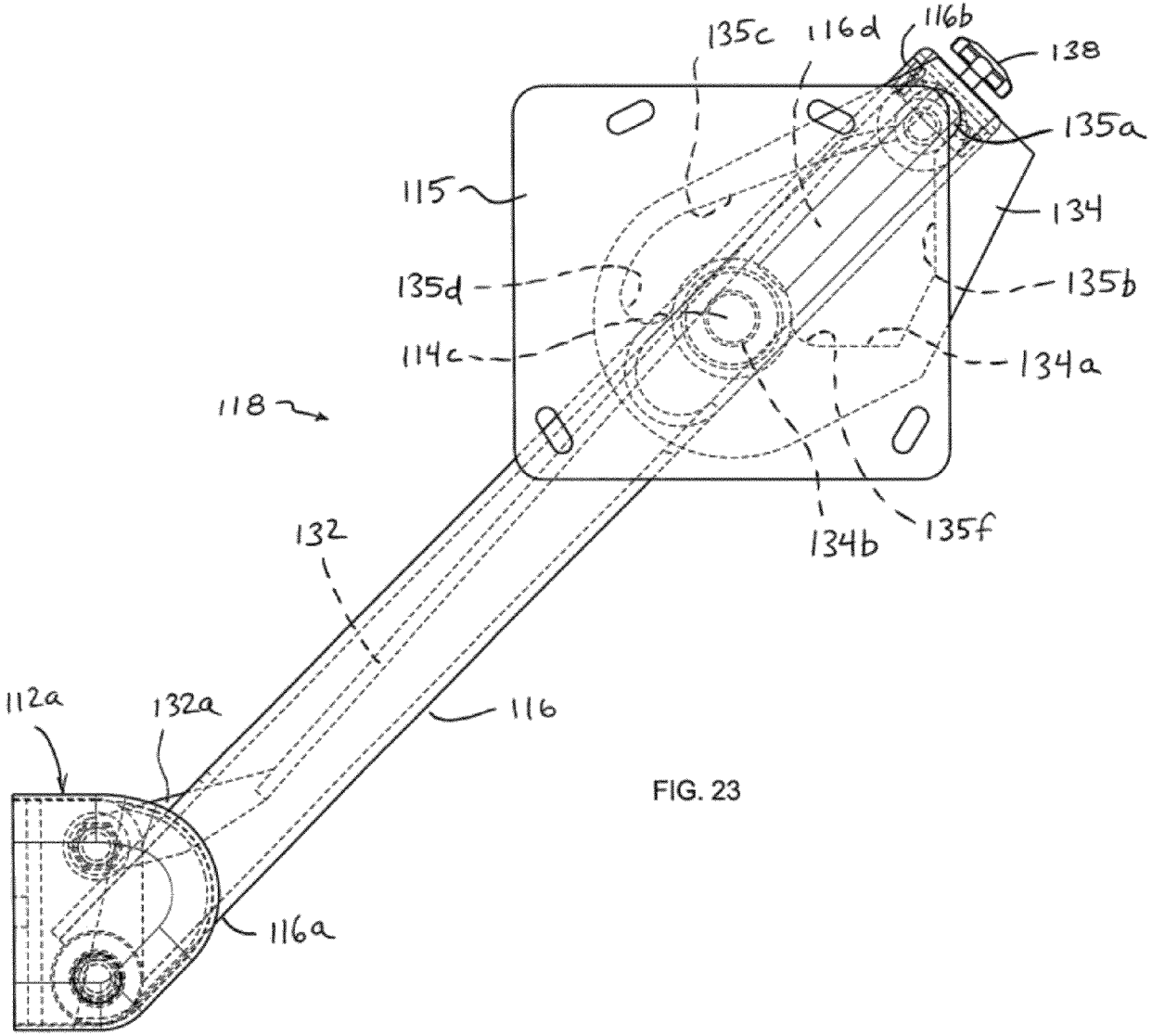
FIGS. 23-27 are top plan views of the base portion, swing arm, control arm and guide element of the seat assembly of the present invention, showing different degrees of pivotal movement of the swing arm relative to the base portion and of the seat and guide element relative to the swing arm and control arm.

As can be seen with reference to FIGS. 22-27, the guide plate 134 controls or limits pivotal movement of the seat responsive to the degree of pivotal movement of the swing arm 116 and corresponding radial movement of the pin 130 along slot 116*d* of swing arm 116, such as in a similar manner as guide plate 34 of seating system 110, discussed above. As shown in FIGS. 22 and 23, locking or limiting portion 135*a* receives guide pin 130 therein when the seat is in its stowed position to limit or substantially preclude pivotal movement of plate 134 (and thus seat 114) about second pivot axis 124 (via the pin 130 engaging either side of the slot-shaped pivot limiting portion 135*a*), such that the seat generally faces the desk portion with the seat back 114*b* facing or generally parallel to the desk portion. When the swing arm 116 is pivoted or swung to this inward position (with the seat in its stowed position), the guide pin 130 engages the swing arm at the end of the guide slot 116*d* (or engages the end of the limiting portion 135*a* of the guide plate profile 134*a* or engages the end 138*a* of the adjustment mechanism 138) to limit or substantially preclude further inward swinging of the swing arm 116 and seat 114 about pivot axis 122. Thus, when the swing arm 116 is pivoted or swung to this inward position, the seat 114 cannot be moved or swung further towards the desk portion and the seat cannot pivot substantially about the second pivot axis, such that the seat back does not or cannot contact or strike the edge of the desk or table.

Figure 24:
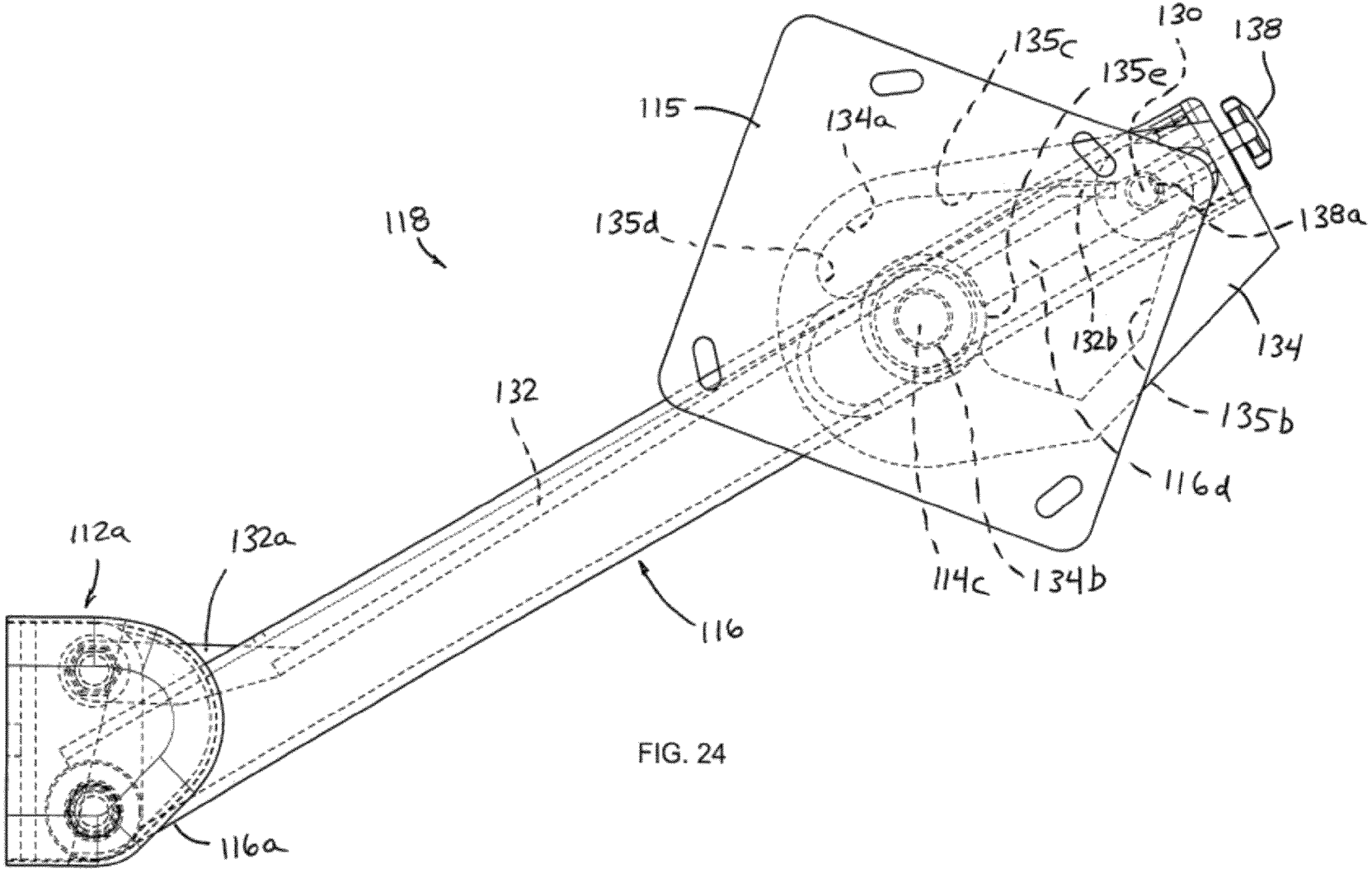

As the swing arm 116 pivots about first pivot axis 122 to move seat 114 away from the desk portion (FIG. 24), guide pin 130 may move along guide surface 134*a* and along and out of locking portion 135*a* to allow for limited pivotal movement of seat 114 relative to swing arm 116. Initial swinging movement of swing arm 116 from the stowed position may allow the seat 114 to pivot slightly away from the base portion 112, such as shown in. FIG. 24, where seat mounting plate 115 is pivoted in a clockwise direction relative to the initial position in FIG. 23, as guide pin 130 moves along and out of portion 135*a* of guide surface 134*a* of guide plate 134. However, guide portion 135*c* of guide surface 134*a* of guide plate 134 limits pivotal movement of seat 114 about pivot axis 124 to a degree of pivoting that does not allow the seat back to contact desk portion 120 (in other words, the seat 114 can only pivot about its pivot axis 124 an amount that still provides clearance between the seat back 114*b* and the edge of the desk portion 120), while guide portion 135*b* of guide surface 134*a* of guide plate 134 limits pivotal movement of seat 114 about pivot axis 124 to a degree of pivoting that would have the seat back be generally parallel to or within a selected angle of the edge of the desk portion. The profile or angle of the guide portions 135*b*, 135*c* of guide plate 134 are selected to allow an appropriate degree of pivoting of the seat about pivot axis 124 in accordance with the location of the pin 130 along the slot 116*d* of swing arm 116, with the amount of allowed seat pivoting increasing as the seat is swung away from the desk.

Figure 25:
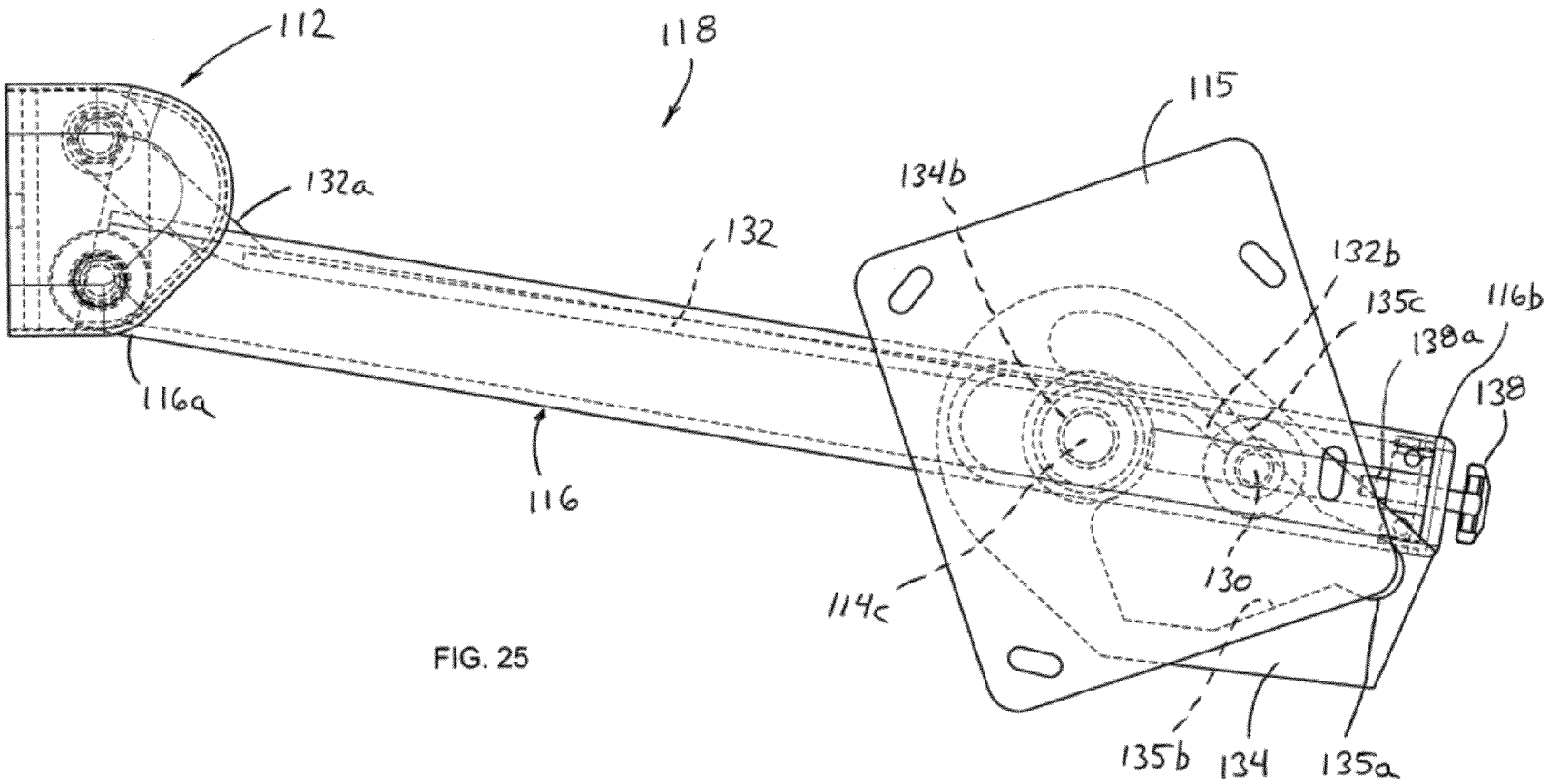
Figure 26:
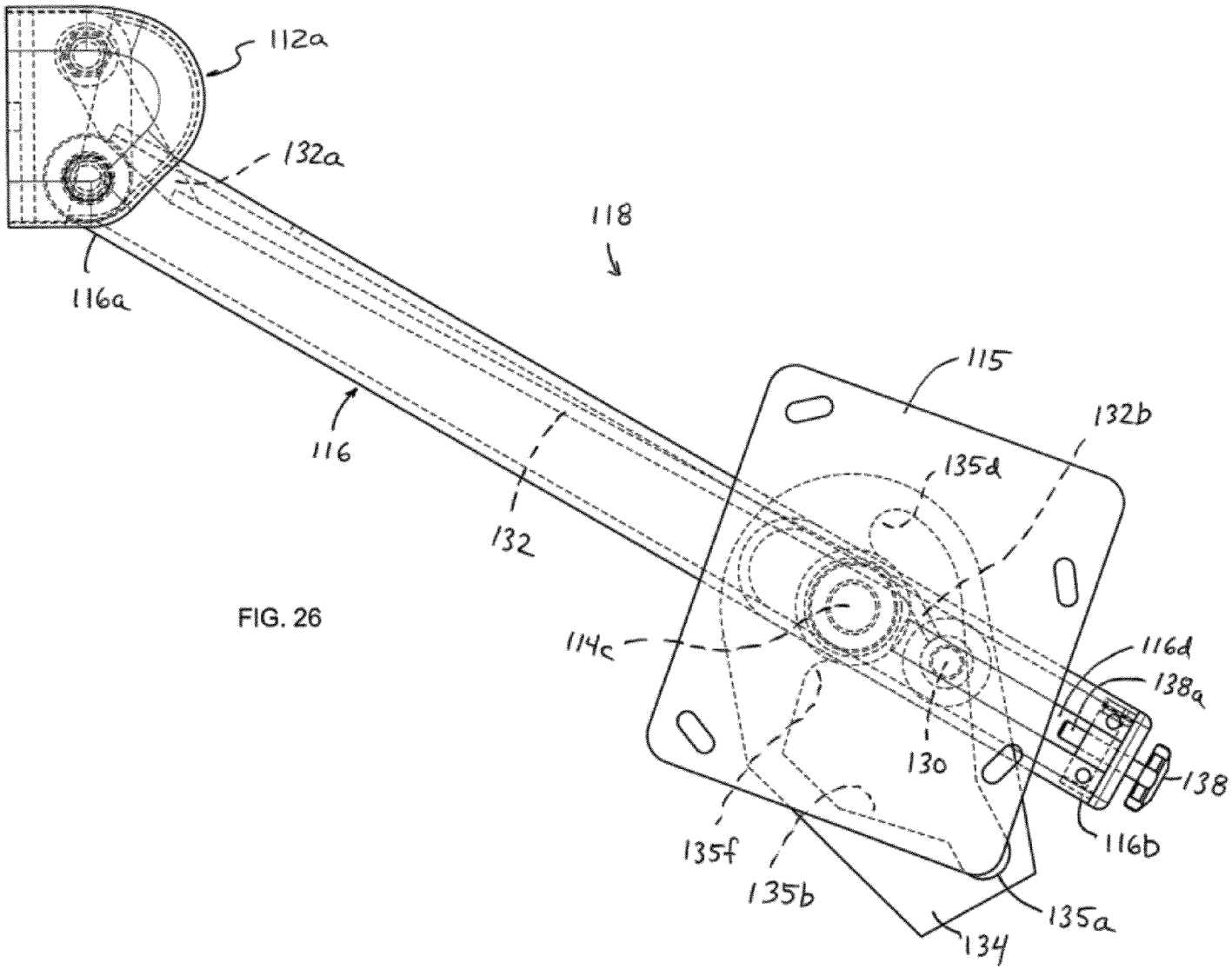

Thus, as swing arm 116 is swung or pivoted further about its pivot axis 122 (such as shown in FIG. 25), the seat may pivot further about its pivot axis 124, while guide pin 130 moves along slot 116*d* and may move along an outward pivot limiting portion 135*c* of guide plate 134 (or may move along or engage inward pivot limiting portion 135*b* if the seat were pivoted in a counterclockwise direction in FIG. 25). As can be seen with reference to FIG. 25, when the swing arm 116 is pivoted outward to this degree, the seat and seat bracket 115 may pivot in the counterclockwise direction so that the seat generally faces the desk portion. When pivoted in such a manner, the guide pin 130 would engage guide surface 134*a* of guide plate 134 at or along the inward pivot limiting portion 135*b* of the guide plate 134 to limit or substantially preclude further counterclockwise pivoting of the seat beyond the position where the seat is generally facing the desk portion (such as would be desired by a person sitting at the seat and using the desk portion). Further pivotal movement of the swing arm 116 about pivot axis 122 (such as shown in FIG. 26) allows for further outward pivoting of seat 114 as guide pin 130 may move further along slot 116*d* and along or relative to guide surface 134*a* at outward pivot limiting portion 135*c* of guide plate 134 (with inward pivot limiting portion 135*b* limiting counterclockwise pivoting of the seat in a similar manner as above).

Figure 27:
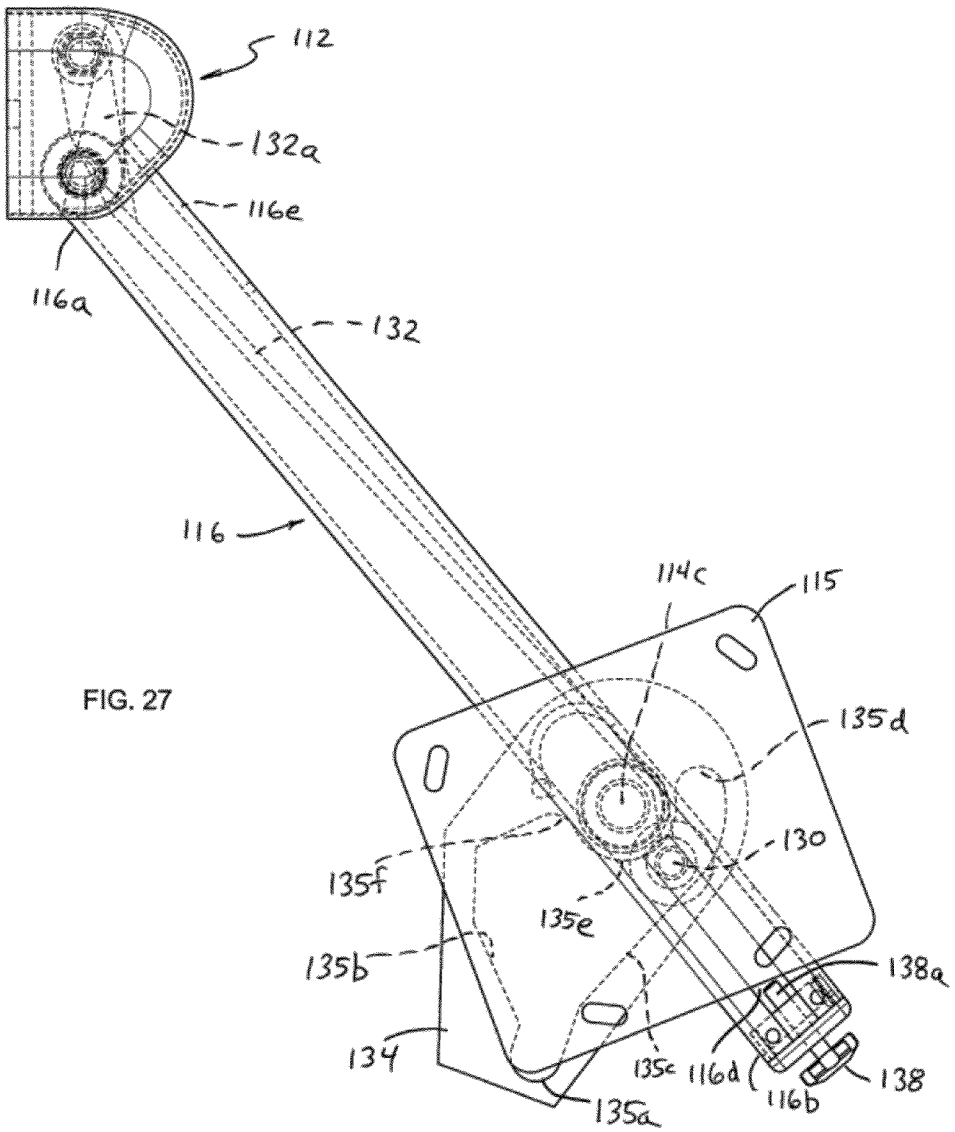

When the swing arm 116 is fully swung outwardly away from desk portion 120 (such as shown in FIG. 27), the guide pin 130 engages swing arm 116 at the proximate or radially inboard end of the guide slot 116*d* to limit further outward pivotal movement of the swing arm and thus of the seat 114 relative to the base portion and desk portion. When the swing arm is at this position, the guide pin 130 is received at the outermost pivot limiting portion 135*d* of guide plate 134, with the seat being pivotable about its pivot axis 124 more than 180 degrees relative to its initial position (although the guide plate profile may otherwise limit the pivotal range of the seat to around 180 degrees or less than about 180 degrees while remaining within the spirit and scope of the present invention). Also, when the swing arm is in this position, the guide plate 134 allows for about 180 degrees (or more or less depending on the particular application of the seating system) of pivotal movement of the seat about its pivot axis 124 as the guide pin may move along an arcuate guide portion 135*e* of guide surface 134*a* of guide plate 134 to another inward pivot limiting portion 135*f*, which may limit or substantially preclude further pivotal movement of the seat 114 and guide plate 134 about pivot axis 124 when the seat is generally facing the desk portion (or optionally facing partially away from the desk portion, depending on the particular shape and profile of the guide element or plate).

Therefore, the seating system or assembly of the present invention provides controlled swinging and pivoting movement of a seat relative to a base portion and/or desk portion as the seat is swung between its stowed position and a pulled back or opened position. The seating system and control system limits or substantially precludes pivotal movement of the seat when the seat is in its stowed position and generally at the desk portion, thus limiting or substantially precluding the seat from pivoting and hitting the edge of the desk, thereby reducing noise and potential damage to the seat or desk portion. The seating system and control system also limits or substantially precludes over-pivoting of the seat as the seat is swung away from the desk portion, such as when a person is moving the seat away from the desk portion to either sit at the seat or get up from the seat. By controlling the pivoting of the seat during such swinging action, the seating system and control system again limits or substantially precludes hitting of the desk portion with the seat back. The seat thus can only pivot fully or substantially about its pivot axis when the seat is swung or moved sufficiently away from the desk portion so that there is clearance for such pivotal movement of the seat without striking the desk portion with the seat back. The present invention thus provides an enhanced seating system with enhanced control of the seat during storage of the seat, use of the seat and movement of the seat while a person is sitting down at the seat or getting up out of the seat.

Changes and modifications to the specifically described embodiments may be carried out without departing from the principles of the present invention, which is intended to be limited only by the scope of the appended claims as being interpreted according to the principles of patent law including the doctrine of equivalents.

The invention claimed is:

1. A swingable and pivotable seating system comprising:

a desk portion;

a base portion generally fixed relative to said desk portion;

a swing arm having a first end pivotally mounted at said base portion and a second end opposite said first end, wherein said swing arm is pivotable about a generally vertical first pivot axis to move said seat towards and away from said desk portion;

a seat pivotally supported at said second end of said swing arm and pivotable about a generally vertical second pivot axis;

wherein said swing arm pivots said seat between a stowed position, where said seat is disposed generally at said desk portion, and an opened position, where said seat is moved away from said desk portion;

a control system that controls pivotal movement of said seat about said second pivot axis responsive to a degree of pivoting of said swing arm about said first pivot axis;

wherein said control system limits pivotal movement of said seat to a varying range of pivotal movement of said seat about said second pivot axis that varies responsive to the degree of pivoting of said swing arm about said first pivot axis; and wherein said control system controls the range of pivotal movement of said seat about said second pivot axis throughout the full range of pivotal movement of said swing arm about said first pivot axis and without user selection of the range of pivotal movement of said seat about said second pivot axis.

2. The swingable and pivotable seating system of claim 1, wherein the varying range of pivotal movement of said seat about said second pivot axis increases as said swing arm pivots about said first axis to move said seat towards said opened position.

3. The swingable and pivotable seating system of claim 1, wherein said control system limits pivotal movement of said seat about said second pivot axis when said seat is at said stowed position.

4. The swingable and pivotable seating system of claim 3, comprising an adjustment mechanism that is adjustable to adjust the location of said seat relative to said desk portion when said seat is in said stowed position.

5. The swingable and pivotable seating system of claim 3, wherein said control system allows at least about 180 degrees of pivotal movement of said seat about said second pivot axis when said seat is at said opened position.

6. The swingable and pivotable seating system of claim 5, wherein said control system controls pivotal movement of said seat about said second pivot axis to allow for varying ranges of pivotal movement of said seat between about zero degrees and at least about 180 degrees responsive to the degree of pivotal movement of said swing arm about said first pivot axis.

7. The swingable and pivotable seating system of claim 6, wherein said control system comprises a control arm and a control element, and wherein a base end of said control arm is pivotally attached at said base portion and a distal end of said control arm has a pin that is slidably received at a slot established partially along said swing arm, and wherein said control element is attached at said seat and engages said pin and controls pivotal movement of said seat as said pin moves along said slot of said swing arm.

8. The swingable and pivotable seating system of claim 7, wherein said control element comprises a plate having an aperture formed therein, and wherein said aperture receives said pin therein and comprises an inner surface profile that limits the range of pivotal movement of said plate and said seat about said second pivot axis responsive to the location of said pin along said slot of said swing arm.

9. A swingable and pivotable seating system comprising:

a base portion;

a swing arm having a first end pivotally mounted at said base portion and a second end opposite said first end, wherein said swing arm is pivotable about a generally vertical first pivot axis;

a seat pivotally supported at said second end of said swing arm and pivotable about a generally vertical second pivot axis;

a control arm having a first end pivotally mounted at said base portion and a second end opposite said first end, wherein said control arm is pivotable about a generally vertical third pivot axis, and wherein said second end of said control arm is movably engaged with a portion of said swing arm distal from said first end of said swing arm;

a control element disposed at and pivotable with said seat about said second pivot axis, wherein a guide element at said second end of said control arm engages said control element to control pivotal movement of said seat about said second pivot axis responsive to a degree of pivoting of said swing arm about said first pivot axis;

a desk portion, wherein said base portion is generally fixed relative to said desk portion; and wherein said swing arm pivots about said first pivot axis to move said seat towards and away from said desk portion, said swing arm moving said seat between a stowed position, where said seat is disposed generally at said desk portion, and an opened position, where said seat is moved away from said desk portion; and wherein said control element is configured to allow a varying and increasing range of pivotal movement of said seat about said second pivot axis as said swing arm pivots about said first pivot axis to move said seat towards said opened position, and wherein said control element is configured to allow a varying and decreasing range of pivotal movement of said seat about said second pivot axis as said swing arm pivots about said first pivot axis to move said seat towards said stowed position.

10. The swingable and pivotable seating system of claim 9, wherein said control element comprises a generally ring-shaped member with a profile established along an inner surface of said ring-shaped member.

11. The swingable and pivotable seating system of claim 10, wherein said guide element moves within said ring-shaped member as said swing arm pivots about said first pivot axis and wherein said inner surface limits movement of said guide element to limit pivotal movement of said seat about said second pivot axis.

12. The swingable and pivotable seating system of claim 9, comprising an adjustment mechanism that is adjustable to adjust the location of said seat relative to said desk portion when said seat is in said stowed position.

13. The swingable and pivotable seating system of claim 9, wherein said control element limits pivotal movement of said seat about said second pivot axis when said seat is at said stowed position.

14. The swingable and pivotable seating system of claim 13, wherein said control element allows at least about 180 degrees of pivotal movement of said seat about said second pivot axis when said seat is at said opened position.

15. The swingable and pivotable seating system of claim 14, wherein said control element controls pivotal movement of said seat about said second pivot axis to allow for varying degrees of pivotal movement of said seat between about zero degrees and at least about 180 degrees responsive to a degree of pivotal movement of said swing arm about said first pivot axis.

16. The swingable and pivotable seating system of claim 9, wherein said first and third pivot axes are spaced apart from one another and are generally parallel to one another.

17. The swingable and pivotable seating system of claim 16, wherein said guide element is movable along said swing arm as said swing arm pivots about said first pivot axis and said control arm pivots about said third pivot axis.

18. A swingable and pivotable seating system comprising:

a base portion;

a swing arm having a first end pivotally mounted at said base portion and a second end opposite said first end, wherein said swing arm is pivotable about a generally vertical first pivot axis;

a seat pivotally supported at said second end of said swing arm and pivotable about a generally vertical second pivot axis;

a control arm having a first end pivotally mounted at said base portion and a second end opposite said first end, wherein said control arm is pivotable about a generally vertical third pivot axis, and wherein said second end of said control arm has a guide element that is movably received in a slot established along a portion of said swing arm distal from said first end of said swing arm;

wherein said first and third pivot axes are spaced apart from one another and are generally parallel to one another and fixed relative to said base portion such that pivotal movement of said swing arm about said second pivot axis imparts movement of said guide element along said slot of said swing arm;

a control element disposed at and pivotable with said seat about said second pivot axis, wherein said control element comprises a generally ring-shaped member with a profile established along an inner surface of said ring-shaped member;

wherein said guide element at said second end of said control arm engages said profile of said inner surface of said control element to control pivotal movement of said seat about said second pivot axis responsive to a degree of pivoting of said swing arm about said first pivot axis and responsive to a position of said guide element along said slot of said swing arm;

a desk portion, wherein said base portion is generally fixed relative to said desk portion;

wherein said swing arm pivots about said first pivot axis to move said seat towards and away from said desk portion, said swing arm moving said seat between a stowed position, where said seat is disposed generally at said desk portion, and an opened position, where said seat is moved away from said desk portion;

wherein said control element limits pivotal movement of said seat about said second pivot axis when said seat is at said stowed position; and wherein said control element controls pivotal movement of said seat about said second pivot axis to allow for varying degrees of pivotal movement of said seat between about zero degrees and at least about 100 degrees responsive to a degree of pivotal movement of said swing arm about said first pivot axis.

19. The swingable and pivotable seating system of claim 18, wherein said guide element moves within said ring-shaped member as said swing arm pivots about said first pivot axis and wherein said inner surface limits movement of said guide element to limit pivotal movement of said seat about said second pivot axis.

20. The swingable and pivotable seating system of claim 18, comprising an adjustment mechanism that is adjustable to adjust the location of said seat relative to said desk portion when said seat is in said stowed position.

21. The swingable and pivotable seating system of claim 18, wherein said control element allows at least about 180 degrees of pivotal movement of said seat about said second pivot axis when said seat is at said opened position.

* * * * *